US006588849B2

(12) United States Patent
Glover et al.

(10) Patent No.: US 6,588,849 B2
(45) Date of Patent: Jul. 8, 2003

(54) JUVENILE SEAT ASSEMBLY HAVING CROTCH STRAP POSITIONING APPARATUS

(75) Inventors: Richard Glover, Greenwood, IN (US); James M. Kain, Troy, OH (US)

(73) Assignee: Cosco Management, Inc., Wilmington, DE (US)

( * ) Notice: Subject to any disclaimer, the term of this patent is extended or adjusted under 35 U.S.C. 154(b) by 0 days.

(21) Appl. No.: 09/900,934

(22) Filed: Jul. 9, 2001

(65) Prior Publication Data

US 2002/0036423 A1 Mar. 28, 2002

Related U.S. Application Data

(60) Provisional application No. 60/234,544, filed on Sep. 22, 2000, and provisional application No. 60/234,666, filed on Sep. 22, 2000.

(51) Int. Cl.[7] ..... A47C 31/00
(52) U.S. Cl. ..... 297/467; 297/250.1
(58) Field of Search ..... 297/250.1, 256.1, 297/256.16, 256.13, 467

(56) References Cited

U.S. PATENT DOCUMENTS 3,031,229 A * 4/1962 Symbaluk
3,709,558 A 1/1973 Jakob
3,791,694 A 2/1974 Roberts et al.
3,910,634 A 10/1975 Morris
3,938,859 A 2/1976 Henderson et al.
3,954,280 A 5/1976 Roberts et al.
3,992,056 A 11/1976 Koziatek et al.
4,025,111 A * 5/1977 Tanaka et al.
4,033,622 A 7/1977 Boudreau
4,040,664 A 8/1977 Tanaka et al.
4,186,961 A 2/1980 Farrell, Jr. et al.
4,343,510 A 8/1982 Cone
4,376,551 A 3/1983 Cone
4,402,548 A 9/1983 Mason
4,411,473 A 10/1983 Ettridge
4,424,760 A 1/1984 Grufman
4,429,916 A 2/1984 Hyde et al.
4,436,341 A 3/1984 Converse
4,456,302 A 6/1984 Knoedler et al.
4,545,613 A 10/1985 Martel et al.
4,580,842 A 4/1986 Segal
4,632,460 A 12/1986 Meeker et al.
4,655,506 A 4/1987 Wise et al.
4,662,683 A 5/1987 Knoedler et al.

(List continued on next page.)

*Primary Examiner*—Milton Nelson, Jr.
(74) *Attorney, Agent, or Firm*—Barnes & Thornburg

(57) ABSTRACT

A juvenile seat assembly includes a seat bottom, a crotch strap, and a carrier coupled to the seat bottom for movement relative to the seat bottom. The crotch strap is part of a child-restraint harness included in the seat assembly. The crotch strap is coupled to and moves with the carrier. The carrier is lockable in a plurality of positions relative to the seat bottom.

44 Claims, 13 Drawing Sheets

U.S. PATENT DOCUMENTS

| | | | |
|---|---|---|---|
| 4,690,455 | A | 9/1987 | Bailey et al. |
| 4,725,253 | A | 2/1988 | Politte |
| 4,738,489 | A | 4/1988 | Wise et al. |
| 4,754,999 | A | 7/1988 | Kain |
| 4,871,210 | A | 10/1989 | Alexander et al. |
| D305,583 | S | 1/1990 | Turner et al. |
| 4,912,818 | A | 4/1990 | Meeker |
| 4,943,112 | A | 7/1990 | Law |
| 4,962,965 | A | 10/1990 | Glover |
| 4,998,307 | A | 3/1991 | Cone |
| 5,061,012 | A | 10/1991 | Parker et al. |
| 5,063,879 | A | 11/1991 | Vorbau |
| 5,074,588 | A | 12/1991 | Huspen |
| 5,092,004 | A | 3/1992 | Cone et al. |
| D325,132 | S | 4/1992 | Cone |
| 5,115,523 | A | 5/1992 | Cone |
| 5,161,855 | A | 11/1992 | Harmon |
| 5,222,641 | A | 6/1993 | Medeiros, Jr. |
| 5,224,756 | A | 7/1993 | Dukatz et al. |
| 5,299,855 | A | 4/1994 | Zubeck |
| 5,310,242 | A | 5/1994 | Golder |
| D353,493 | S | 12/1994 | Schwartzkopf et al. |
| 5,451,093 | A | 9/1995 | Petrie et al. |
| 5,496,092 | A | 3/1996 | Williams et al. |
| D369,911 | S | 5/1996 | Turner |
| 5,533,786 | A | 7/1996 | Cone, II |
| 5,538,322 | A | 7/1996 | Cone et al. |
| 5,567,008 | A | 10/1996 | Cone, II |
| 5,593,207 | A | 1/1997 | Turner |
| 5,599,063 | A | 2/1997 | Lister et al. |
| 5,625,956 | A | 5/1997 | Cone, II et al. |
| 5,690,382 | A | 11/1997 | Cone |
| 5,713,630 | A | 2/1998 | Kvalvik |
| 5,779,319 | A | 7/1998 | Merrick |
| 5,816,652 | A | 10/1998 | Cone et al. |
| D402,477 | S | 12/1998 | Cone, II |
| 5,868,465 | A | 2/1999 | Kvalvik |
| 5,890,769 | A | 4/1999 | Fairbanks |
| 5,964,502 | A | 10/1999 | Stephens |
| 5,971,492 | A | 10/1999 | Pitman |
| 6,000,753 | A | 12/1999 | Cone, II |
| 6,068,335 | A | 5/2000 | Glover |
| 6,089,662 | A | 7/2000 | Lambert et al. |
| D429,075 | S | 8/2000 | Cone, II |
| 6,179,329 | B1 | 1/2001 | Bradley |
| 6,186,521 | B1 | 2/2001 | Divoky et al. |
| 6,205,600 | B1 | 3/2001 | Sedlack |

* cited by examiner

JUVENILE SEAT ASSEMBLY HAVING CROTCH STRAP POSITIONING APPARATUS

This patent application claims priority under 35 U.S.C. §119(e) to U.S. Provisional Patent Application Ser. No. 60/234,544, filed Sep. 22, 2000, and U.S. Provisional Patent Application Ser. No. 60/234,666, also filed Sep. 22, 2000, the disclosures of which are hereby incorporated herein by reference.

BACKGROUND AND SUMMARY OF THE INVENTION

The present invention relates to a juvenile seat assembly, and particularly, to a juvenile seat assembly including a safety harness that adjusts to accommodate children of different sizes. More particularly, the present invention relates to a juvenile seat assembly having a crotch strap positioning apparatus.

Juvenile seat assemblies having safety harnesses to restrain children in place are well known. Such juvenile seat assemblies are often included in car seats, child swings, and strollers. Harnesses used in juvenile seat assemblies usually include a number of straps, including shoulder straps and crotch straps.

As the size of a child to be restrained in a juvenile seat assembly changes, either due to growth of the child or due to changes in the thickness of the clothing worn by the child, adjustments in the connection points of the straps to the seat back and seat bottom or adjustments in the length of the straps are sometimes made. Adjusting the harnesses of some conventional juvenile seat assemblies can be a cumbersome, time consuming process. As a result, caregivers of children may forego harness adjustments at the expense of the comfort of the children. Efforts have been made by manufacturers of juvenile seat assemblies to provide harness adjustment mechanisms that are easy and quick to use so that caregivers of children are more apt to make harness adjustments when needed.

According to the present disclosure, a juvenile seat assembly includes a seat bottom, a crotch strap, and a carrier coupled to the seat bottom for movement relative to the seat bottom. The crotch strap is a part of a child-restraint harness included in the seat assembly. The carrier is lockable in a plurality of positions and the crotch strap is coupled to the carrier to move therewith.

The juvenile seat assembly also includes a lock member coupled to the seat bottom. The lock member is movable between a locking position engaging the carrier to prevent the carrier from moving relative to the seat bottom and a releasing position disengaged from the carrier to allow movement of the carrier relative to the seat bottom.

In an illustrative embodiment, the seat bottom is formed to include a channel and the carrier is received in the channel for sliding movement along a path toward and away from a seat back extending upwardly from the seat bottom. In addition, the lock member is positioned to lie underneath the seat bottom and is coupled to the seat bottom for pivoting movement between the locking and releasing positions.

The illustrative lock member includes a release button that is accessible at a front end of the seat bottom and a locking tab that extends through an aperture formed in the seat bottom. When the lock member is in the locking position, the locking tab is received in a selected one of a plurality of lock-receiving spaces formed in the carrier to lock the carrier in place relative to the seat bottom. By locking the carrier in place on the seat bottom, the location of the crotch strap relative to a seat back in the seat assembly is fixed so as to adjust the child-restraint harness to adapt to the size of a child occupying the seat assembly.

When a user moves the release button upwardly, the lock member pivots from the locking position to the releasing position causing the locking tab to move downwardly out of the selected lock-receiving space. After the lock member is moved to the releasing position, the carrier and the crotch strap are movable relative to the seat bottom so that adjustments in the position of the crotch strap can be made easily by a caregiver. The crotch strap and carrier can be moved closer to the seat back to adjust the harness to accommodate a smaller child and farther away from the seat back to adjust the harness to accommodate a larger child.

According to a first illustrative embodiment, a crotch strap is fastened to the carrier and a buckle is coupled to an upper end of the crotch strap. Tabs coupled to shoulder straps of the child-restraint harness are attachable to and detachable from the buckle. According to a second illustrative embodiment, a harness tab coupled to a lower end of a harness strap is attachable to and detachable from the carrier. In the second embodiment, the carrier is formed to include a slot that receives the harness tab. A slidable lock member of the carrier engages the harness tab to lock the harness tab to the carrier. The slidable lock member includes a release button that, when pressed, allows the harness tab to be detached from the carrier.

Additional features of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
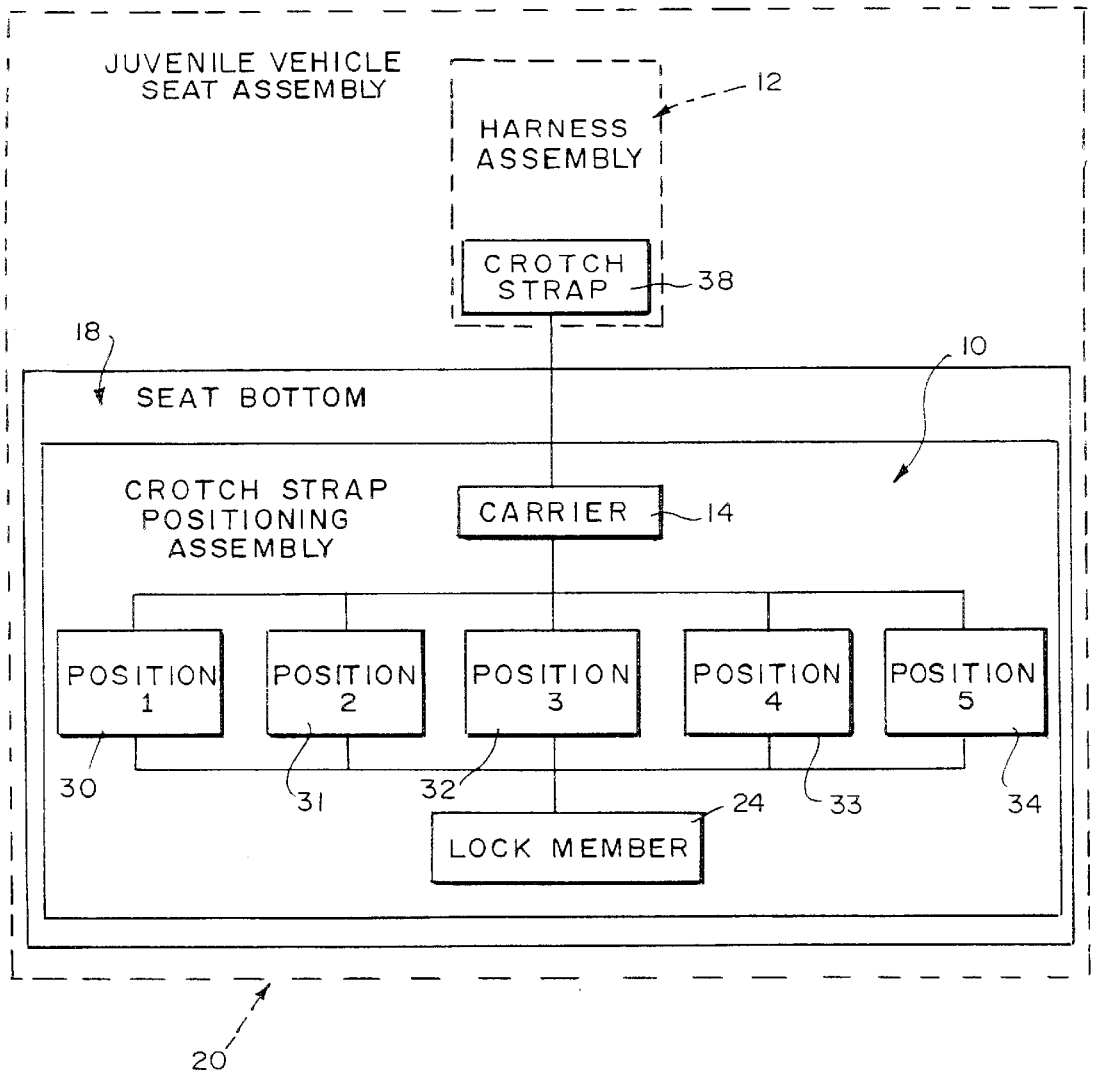
FIG. 1 is a diagrammatic view of portions of a juvenile seat assembly showing the interrelation of components that selectively position a crotch strap of a harness assembly relative to a seat bottom, the crotch strap being coupled to a carrier that is movable into five selected positions relative to the seat bottom, and the juvenile seat assembly including a lock member that locks the carrier into a selected one of the five positions.
Figure 2:
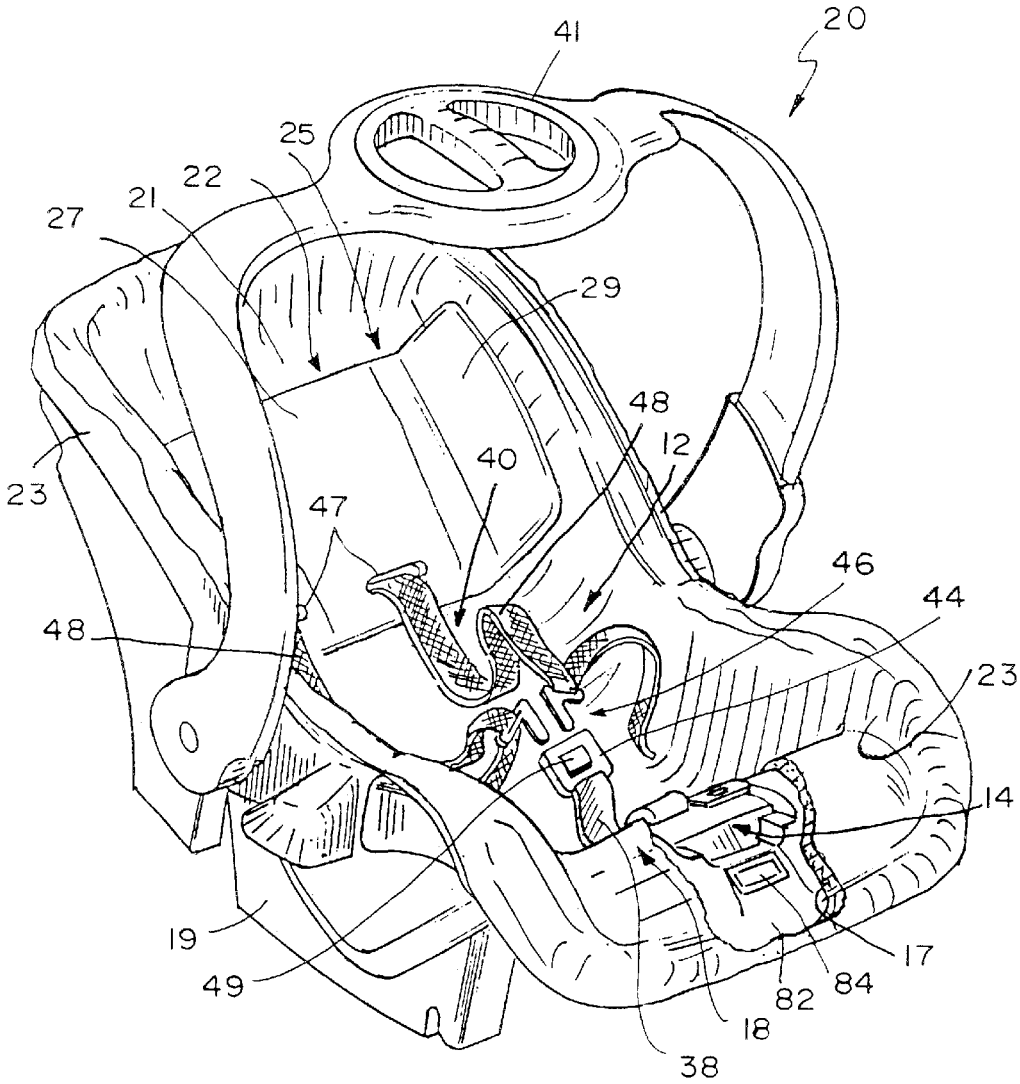
FIG. 2 is a perspective view of a juvenile seat assembly showing a seat including a seat back and a seat bottom, a crotch strap extending upwardly relative to the seat bottom, a pair of shoulder straps extending from the seat back, a pair of shoulder strap fasteners coupled to the shoulder straps and positioned for insertion into a buckle coupled to an upper end of the crotch strap, and a release button accessible at a front end of the seat bottom.
Figure 3:
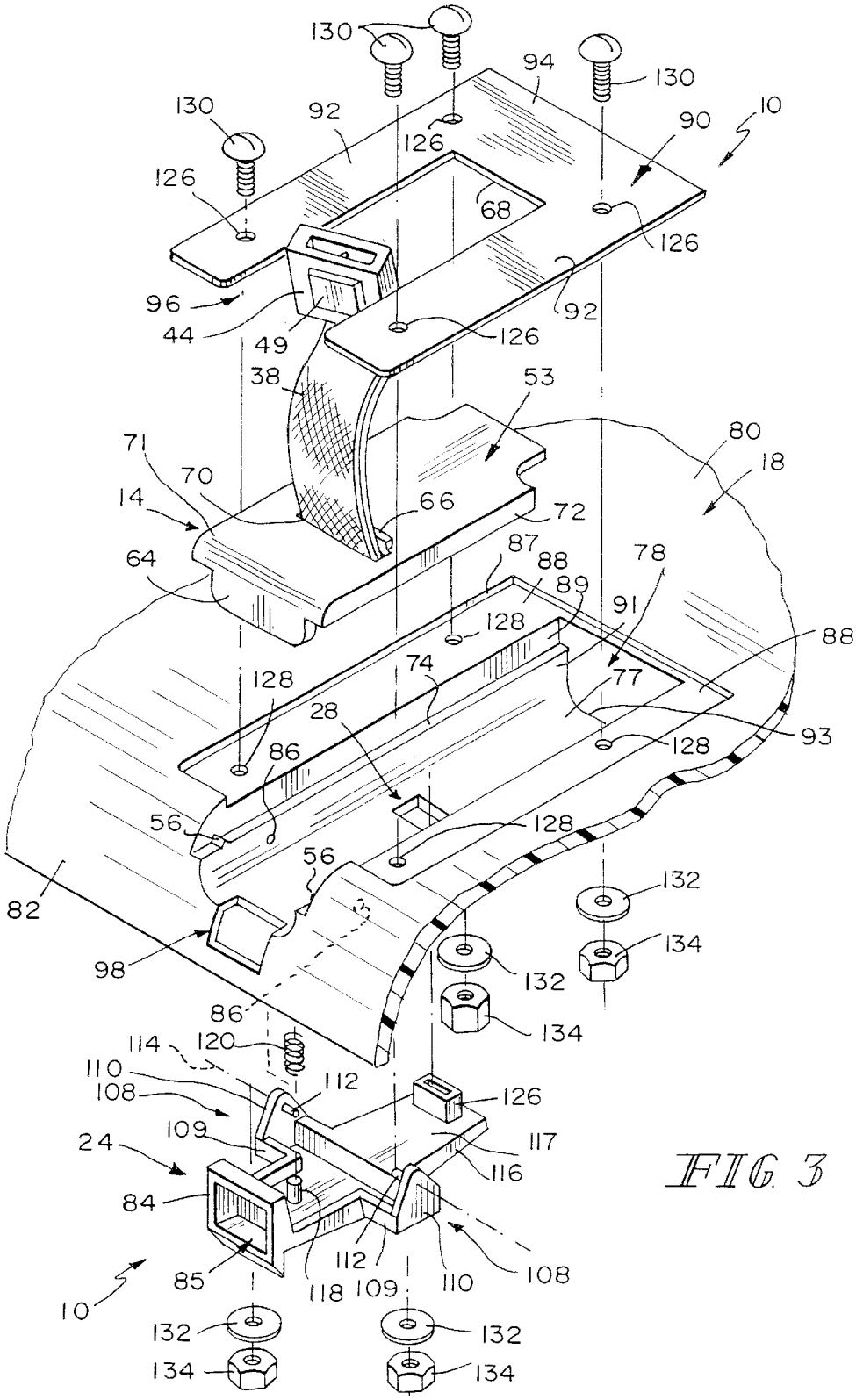
FIG. 3 is an exploded perspective view of portions of the seat assembly of FIG. 2 showing the seat bottom having a channel formed therein, a carrier of a crotch strap positioning assembly situated above the channel, a plate situated above the carrier, the crotch strap coupled to the carrier and extending upwardly therefrom, a lock member of the crotch strap positioning assembly situated beneath the channel, the lock member being formed to include the release button at one end thereof and a locking tab at the other end thereof, and the lock member being formed to include a pair of pivot flanges and pivot pins that are positioned to lie between the release button and the locking tab.
Figure 4:
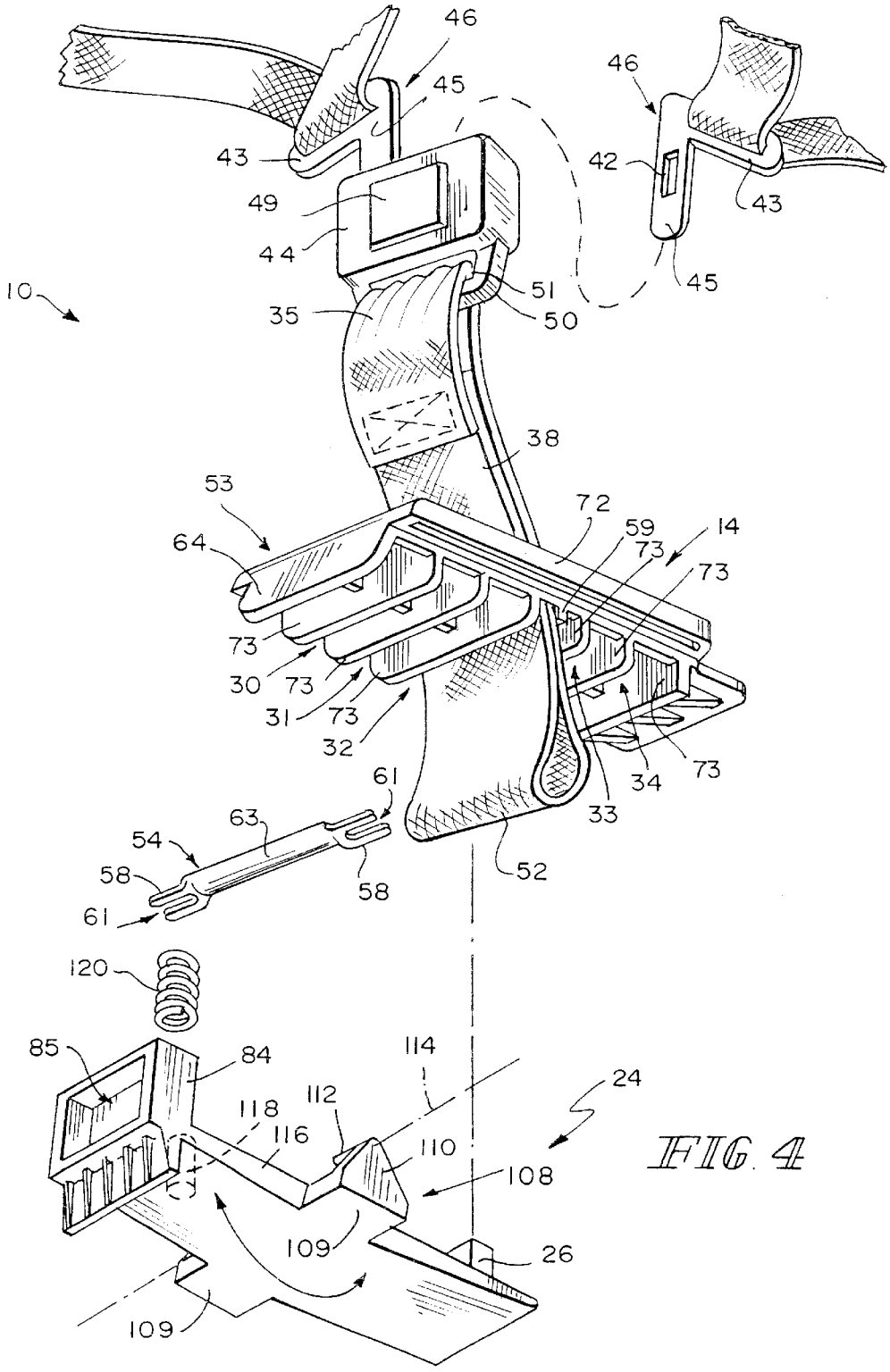
FIG. 4 is an exploded perspective view of the crotch strap positioning assembly of FIG. 3 showing a lower end of the crotch strap formed as a loop, a strap retainer arranged for insertion into the loop, the strap retainer being configured to couple to an underside of the carrier, the carrier including a plurality of downwardly extending ribs between which are defined a plurality of lock-receiving spaces, and the locking tab of the lock member being sized for receipt in each of the lock-receiving spaces.
Figure 5:
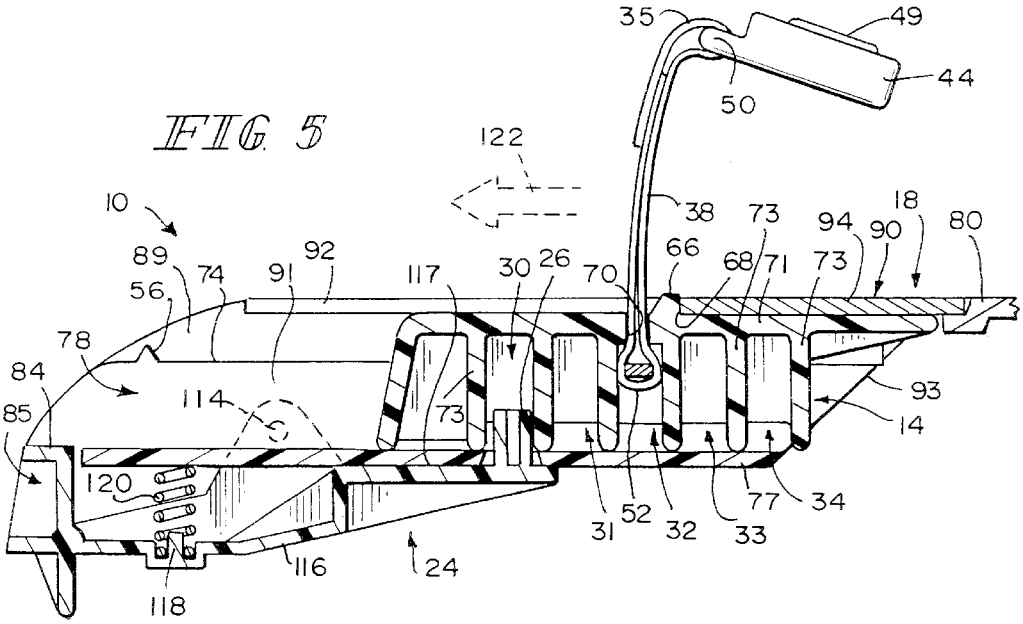
FIG. 5 is a sectional view taken through the crotch strap positioning assembly showing the lock member in a locking position having the locking tab of the lock member received in a first lock-receiving space to lock the carrier in a first position, a spring biasing the lock member about the pivot pins into the locking position, and a phantom arrow indicating the direction that the crotch strap and the carrier are movable when the release button is lifted upwardly to pivot the lock member against the bias of the spring into a releasing position having the locking tab withdrawn from the first lock-receiving space.
Figure 6:
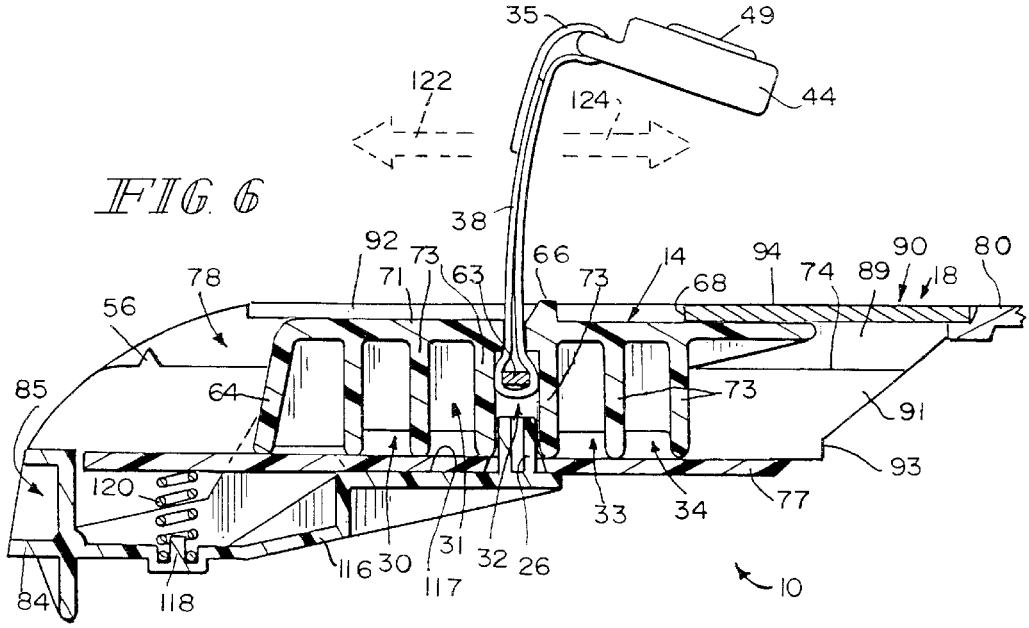
FIG. 6 is a sectional view similar to FIG. 5 showing the lock member in the locking position having the locking tab received in a third lock-receiving space to lock the carrier in a third position and a pair of phantom arrows indicating that the crotch strap and the carrier are movable in first and second opposite directions when the lock member is moved to the releasing position.
Figure 7:
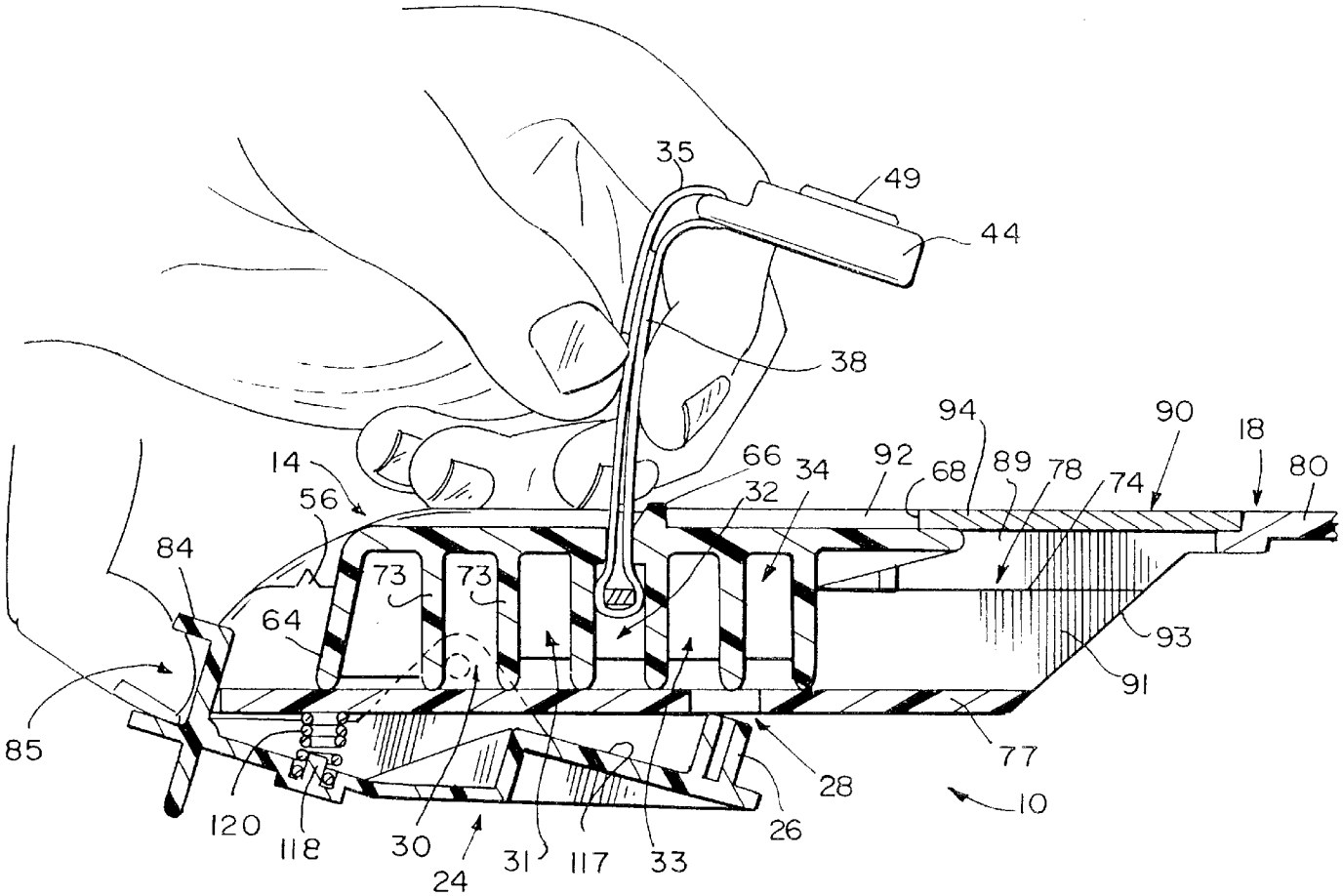
FIG. 7 is a sectional view similar to FIG. 6 showing the lock member moved to the releasing position by a user and showing the user gripping the crotch strap to reposition the crotch strap and carrier relative to the seat bottom.
Figure 8:
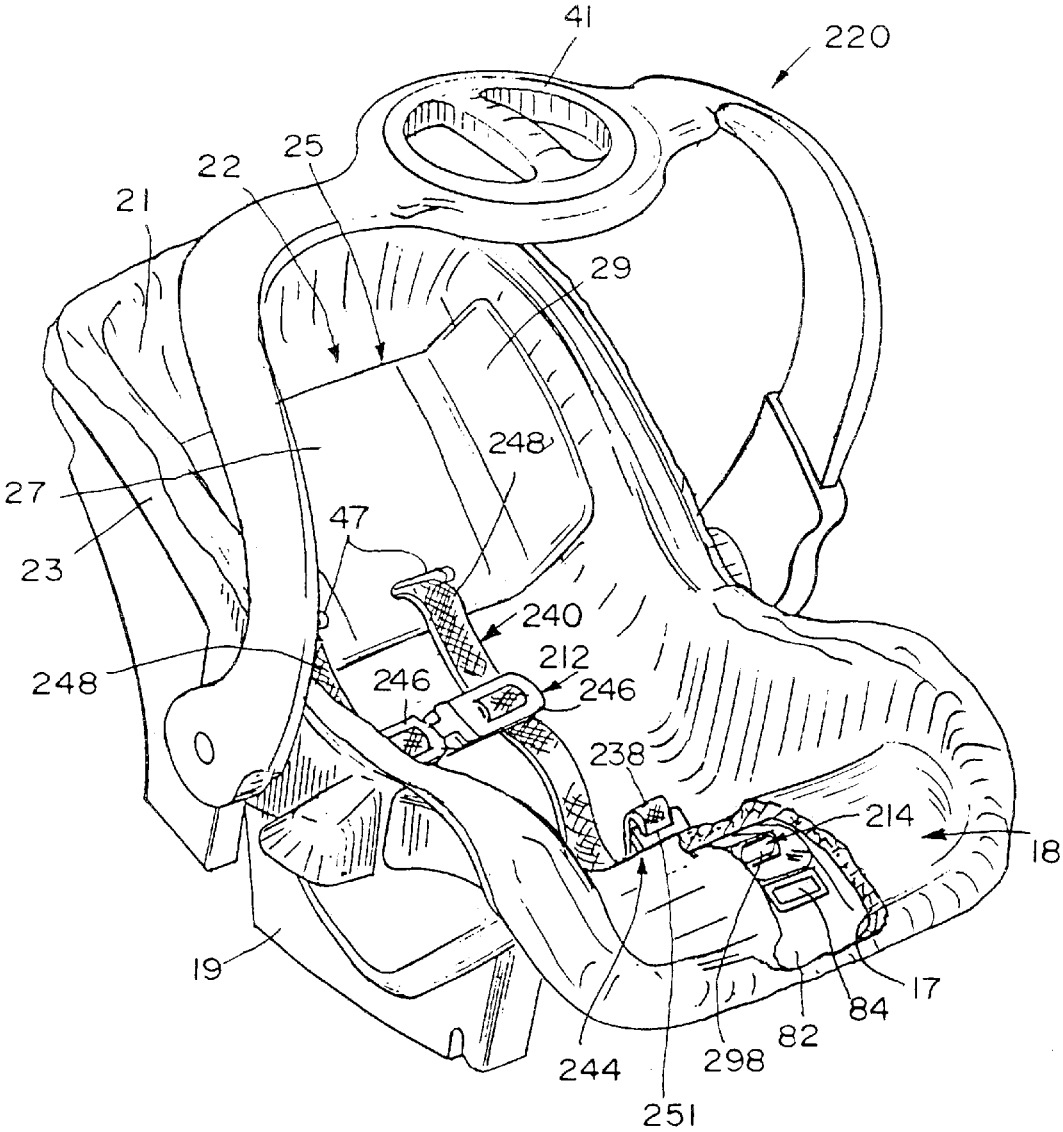
FIG. 8 is a perspective view of an alternative embodiment of a juvenile seat assembly showing a seat including a seat back and a seat bottom, a harness assembly extending between the seat back and the seat bottom, a first release button accessible at a front end of the seat bottom, and a second release button above and slightly to the rear of the first release button.

The general principles of a crotch strap positioning assembly 10 included as part of a juvenile seat assembly 20 are depicted diagrammatically in FIG. 1. A first embodiment of a seat assembly 20 is shown in FIG. 2. Details of crotch strap positioning assembly 10 are shown in FIGS. 3 and 4. The manner in which a lock member 24 of assembly 10 operates to lock and release a carrier 14 to which a crotch strap 38 is coupled is shown in FIGS. 5–7. An alternative juvenile seat assembly 220 is shown in FIG. 8. An alternative crotch strap positioning assembly 210 included as part of seat assembly 220 and the operation of assembly 210 to adjust the position of a harness strap 240 are shown in FIGS. 9–17.

Referring to FIG. 1, a juvenile seat assembly 20 includes a seat bottom 18, a child-restraint harness assembly 12 including a harness strap or crotch strap 38, and a crotch strap positioning assembly 10. Harness assembly 12 is configured to restrain a child (not shown) seated in seat assembly 20 and is of the type commonly referred to as a five-point harness assembly. Positioning assembly 10 includes a carrier 14 to which crotch strap 38 couples. Carrier 14 is coupled to seat bottom 18 and is movable relative to seat bottom 18 between, illustratively, five positions 30, 31, 32, 33, 34. Positioning assembly 10 also includes a lock member 24 coupled to seat bottom 18. Lock member 24 engages carrier 14 to lock carrier 14 in a selected one of positions 30, 31, 32, 33, 34. In use, a user will operate positioning assembly 10 to place carrier 14 in one of the five positions 30, 31, 32, 33, 34 based on the size of the child seated in seat assembly 20.

In a first illustrative embodiment, seat bottom 18 is formed integrally with a seat back support 21 and with a base coupling structure 19 as shown in FIG. 2. Seat assembly 20 includes a seat back 22 mounted on seat back support 21. Base coupling structure 19 is configured to couple to a base (not shown) that is mounted on a vehicle seat or that is included in other types of juvenile equipment, such as, for example, a child swing or a stroller. One such base is shown and described in U.S. patent application Ser. No. 09/614, 078, filed Jul. 11, 2000, which is titled CHILD VEHICLE SEAT WITH ADJUSTABLE AND REMOVABLE BASE and which is hereby incorporated herein by reference.

A pair of side walls 23 are appended to seat bottom 18 and to seat back support 21. Side walls 23 extend substantially vertically upwardly from seat bottom 18 and seat back support 21 to prevent the child seated in seat assembly 20 from moving laterally off of seat assembly 20. Seat assembly 20 includes a layer of cloth-encased padding 17 that covers seat bottom 20, seat back support 21, and side walls 23 to enhance the comfort of the child seated in seat assembly 20. Illustrative seat assembly 20 also includes a carrying handle 41 coupled to side walls 23. Carrying handle 41 is gripped by a user to carry seat assembly 20 and the child seated therein when seat assembly 20 is decoupled from the associated base. It will be appreciated that padding 17 and handle 41 are optional components and therefore, in alternative embodiments, these components are omitted.

Harness assembly 12 includes a shoulder harness 40 having a pair of harness straps or shoulder straps 48 that extend over the shoulders of the child seated in seat assembly 20. Seat back 22 is formed to include a pair of laterally extending slots 47 as shown in FIG. 2. Shoulder straps 48 are threaded from a back side of seat back 22, through slots 47, and then through slots (not shown) formed in padding 17 and seat bottom 18. Seat back 22 includes a panel 25 having a back plate 27 and a pair of wings 29 appended to opposite sides of back plate 27. Optionally, seat back 22 includes a layer of cloth-covered padding (not shown) that covers panel 25 to enhance the comfort of the child seated in seat assembly 20. Panel 25 is movable along seat back support 21 relative to seat bottom 18 to adjust the distance between slots 47 and seat bottom 18.

Seat assembly 20 includes a panel-height adjustment mechanism (not shown) that is situated on the back side of seat assembly 20 and that locks seat back 22 in various positions relative to seat back support 21. In addition, shoulder straps 48 are coupled to a shoulder strap adjustment mechanism (not shown) that is also situated on a back side of seat assembly 20. In use, the panel-height adjustment mechanism and the shoulder strap adjustment mechanism are operated so that the position of seat back 22 and the length of shoulder straps 48 are appropriate for the size of the child seated in seat assembly 20. Details of an exemplary panel-height adjustment mechanism can be found in U.S. Provisional Patent Application Ser. No. 60/614,078 which is already incorporated by reference herein. Details of exemplary shoulder strap adjustment mechanisms can be found in U.S. patent application Ser. No. 09/592,331 titled STRAP ADJUSTER FOR JUVENILE VEHICLE SEAT, filed Jun. 13, 2000, now abandoned, and in U.S. patent application Ser. No. 09/258,453 titled HARNESS FOR JUVENILE VEHICLE SEAT, filed Feb. 26, 1999, now U.S. Pat. No. 6,189,970, both of these applications being hereby incorporated herein by reference.

Harness assembly 12 includes a buckle 44 coupled to an upper end of crotch strap 38 as shown in FIGS. 2–4. In the illustrative embodiment, the upper end of crotch strap is formed as a loop 35 and buckle 44 includes a flange 50 that is formed to include a slot 51 which receives loop 35 of crotch strap 38 as shown best in FIG. 4. Harness assembly 12 also includes a pair of shoulder strap tabs 46, each of which includes a slotted first portion 43 through which respective shoulder straps 48 are threaded and each of which includes a second portion 45 that is insertable into buckle 44 as also shown best in FIG. 4. Second portion 45 of tabs 46 are each formed to include an aperture 42 and buckle 44 includes locking elements (not shown) that are received in apertures 42 when tabs 46 are inserted into buckle 44 to lock tabs 46 and buckle 44 together in a conventional manner. Buckle 44 includes a button 49 that is pressed to unlock tabs 46 from buckle 44 allowing removal of tabs 46 from buckle 44.

Crotch strap positioning assembly 10 includes a carrier 14 and a lock member 24 as shown, for example, in FIGS. 3 and 4. Crotch strap 38 is coupled to carrier 14 and extends upwardly therefrom. Carrier 14 is coupled to seat bottom 18 for longitudinal translating movement relative to seat bottom 18. Thus, carrier 14 is movable on seat bottom 18 in a forward direction (i.e. away from seat back 22) as indicated by phantom arrow 122, shown in FIGS. 5 and 6, and in a rearward direction (i.e. toward seat back 22) as indicated by phantom arrow 124, shown in FIG. 6.

Lock member 24 is coupled to seat bottom 18 and is movable between a locking position, shown in FIGS. 5 and 6, and a releasing position, shown in FIG. 7. When lock member 24 is in the locking position, lock member 24 engages carrier 14 preventing carrier 14 from moving relative to seat bottom 18. By locking carrier 14 in place on seat bottom 18, the location of crotch strap 38 relative to seat back 22 of seat assembly 20 is fixed in one of five positions 30, 31, 32, 33, 34, thereby adapting harness 40 to the size of the child occupying seat assembly 20. When lock member 24 is moved to the releasing position, lock member 24 disengages from carrier 14 allowing carrier 14 to move relative to seat bottom 18 so that adjustments in the position of crotch strap 38 relative to seat bottom 18 can be made easily by a caregiver. Thus, when lock member 24 is in the releasing position, carrier 14 and crotch strap 38 can be moved closer to seat back 22 to adjust harness assembly 40 to accommodate a smaller child and farther away from seat back 22 to adjust harness assembly 40 to accommodate a larger child.

Seat bottom 18 includes a top wall 80 and a front wall 82 appended to top wall 80. Illustrative top wall 80 and front wall 82 blend together smoothly along an arc to provide a laterally extending, radiused corner between walls 80, 82 as shown best in FIG. 3. Seat bottom 18 is formed to include an elongated channel 78 having an open top at top wall 80 and an open end at front wall 82. Illustrative channel 78 has a stepped configuration including a pair of upper vertical walls 87 extending downwardly from top wall 80 of seat bottom 18, a pair of first shoulder walls 88 extending inwardly from respective walls 87 toward the centerline of channel 78, a pair of intermediate vertical walls 89 extending downwardly from respective walls 88, a pair of second shoulder walls 74 extending inwardly from respective walls 89 toward the centerline of channel 78, a pair of lower vertical walls 91 extending downwardly from respective walls 89, and a bottom channel wall 77 extending laterally between walls 91. Illustrative channel 78 is open at its rear end. In alternative embodiments, seat bottom 18 includes a rear channel wall extending between top wall 80 and bottom channel wall 77 at the rear end of channel 78. Thus, channel 78 is defined by and bounded by walls 74, 77, 87, 88, 89, 91. In addition, each of walls 74, 77, 87, 88, 89, 91 extends longitudinally rearwardly from front wall 82 of seat bottom 18 and terminates at a rear edge 93.

Seat bottom 18 is formed to include a first aperture 98 and a second aperture 28 as shown in FIG. 3. Aperture 98 is formed in seat bottom 18 at the junction between front wall 82 and bottom channel wall 77. Aperture 28 is formed in bottom channel wall 77 between aperture 98 and rear edge 93 of channel 78. In addition, each lower vertical wall 91 is formed to include a pivot aperture 86. Pivot apertures 86 are aligned with one another and are situated about midway between aperture 28 and aperture 98.

Lock member 24 includes an elongated lever portion or first portion 116, a locking tab or second portion 26 appended to lever portion 116 adjacent a rear end of lever portion 116, and a release button or third portion 84 appended to the front end of lever portion 116. Lock member 24 also includes a pair of pivot flanges 108 appended to respective sides of lever portion 116 about midway between locking tab 26 and release button 84. Pivot flanges 108 each include a first portion 109 extending laterally away from lever portion 116 and a second portion 110 extending upwardly from the respective first portion 109. Lock member 24 includes a pair of pivot pins 112, each of which is appended to a respective second portion 110 of pivot flanges 108. Pivot pins 112 extend in a cantilevered fashion laterally inwardly from portions 110 toward one another.

Pivot pins 112 of lock member 24 are received in respective apertures 86 formed in lower vertical walls 91. Pins 112 cooperate with apertures 86 to define a pivot axis 114 about which lock member 24 pivots when lock member 24 moves between the locking and releasing positions. Lock member 24 is sized and configured so that release button 84 is positioned to lie in aperture 98 and so that locking tab 26 extends upwardly through aperture 28 into engagement with carrier 14 when lock member 24 is in the locking position.

Seat assembly 20 includes a biasing element 120 that biases lock member 24 into the locking position. Illustrative biasing element 120 is a coil spring (hereinafter referred to as spring 120) having a top end abutting an underside of bottom channel wall 77 and having a bottom end abutting lever portion 116 at a location between release button 84 and pivot flanges 108. Lock member 24 includes a post 118 appended to lever portion 116 and extending upwardly therefrom as shown, for example, in FIG. 3. Post 118 is received in a bore of spring 120 to hold spring 120 in place relative to lock member 24 and seat bottom 18. Spring 120 is maintained in a state of compression between lock member 24 and seat bottom 18 to provide the biasing force that urges lock member 24 toward the locking position. Lever portion 116 includes a stop surface 117 that is biased by spring 120 into abutment with an underside of channel bottom wall 77 when lock member 24 is in the locking position as shown in FIGS. 5 and 6.

Release button 84 is formed to include a recess 85 that is configured to receive one or more of a user's fingers, as shown in FIG. 7, to enable the user to lift upwardly on release button 84 thereby causing lock member 24 to pivot about pivot axis 114 from the locking position to the releasing position. As lock member 24 moves from the locking position to the releasing position, spring 120 is further compressed between lever portion 116 and seat bottom 18. Furthermore, as lock member 24 moves from the locking position to the releasing position, locking tab 26 moves downwardly through aperture 28 to disengage from carrier 14.

Carrier 14 is received in channel 78 and slides back and forth therein to adjust the position of crotch strap 38 as mentioned previously. Seat assembly 20 includes a plate 90 coupled to seat bottom 18 to retain carrier 14 in channel 78. Plate 90 is a substantially flat, planar element and includes a pair of spaced-apart side portions 92 interconnected by an end portion 94 such that plate 90 is generally U-shaped as shown in FIG. 3. Thus, side portions 92 cooperate with end portion 94 to define a slot 96 in plate 90. Crotch strap 38 extends upwardly from carrier 14 through slot 96. In addition, crotch strap 38 moves in slot 96 away from end portion 94 when carrier 14 moves forwardly relative to seat bottom 18 in direction 122 and crotch strap 38 moves in slot 96 toward end portion 94 when carrier 14 moves rearwardly relative to seat bottom 18 in direction 124.

Plate 90 rests upon first shoulder walls 88 and attaches thereto by suitable fasteners. Illustratively, plate 90 is formed to include a set of four apertures 126 and first shoulder walls 88 are formed to include apertures 128 that are aligned vertically with apertures 126. Seat assembly 20 includes a set of four bolts 130 that are inserted downwardly through apertures 126, 128 so that respective heads of bolts 130 rest against the upper surface of plate 90 and so that threaded lower ends of bolts 130 are positioned to lie beneath first shoulder walls 88 of seat bottom 18. Seat assembly 20 includes a set of four washers 132 and four hex nuts 134. Washers 132 abut the underside of walls 88 and nuts 134 are threaded onto the threaded lower ends of bolts 130. Thus, bolts 130 cooperate with washers 132 and nuts 134 to couple plate 90 to seat bottom 18. Those skilled in the art will appreciate that fasteners such as, for example, snaps, tabs, hooks, adhesives, rivets, and the like may be used to couple plate 90 to seat bottom in lieu of bolts 130, washers, 132, and nuts 134.

A part of side portions 92 and a part of end portion 94 of plate 90 extend over carrier 14 to prevent carrier 14 from being lifted upwardly out of channel 78. The thickness of plate 90 is approximately the same as the vertical height of upper vertical walls 87. Thus, the upper surface of plate 90 is generally coplanar with the upper surface of top wall 80 of seat bottom 18. The regions of plate 90 around apertures 126 are formed to include countersink recesses (not shown) that receive the heads of respective bolts 130 to minimize the amount that the heads protrude above plate 90. In addition, plate 90 is sized so that only a minimal amount of clearance exists between the side edges of side portions 92 and upper vertical walls 87 and so that only a minimal amount of clearance exists between the rear end edge of end portion 94 and top wall 80 of seat bottom 18. Thus, plate 90 occupies channel 78 in the space above first shoulder walls 88, whereas carrier 14 occupies channel 78 in the space defined between plate 90 and bottom channel wall 77.

Carrier 14 includes a main body 53 and a retainer 54 coupled to main body 53 as shown in FIG. 4. A lower end of crotch strap 38 is formed as a loop 52 that receives retainer 54. Main body 53 is formed to include a slot 70, shown in FIG. 3, and retainer 54 is situated on an underside of main body 53 beneath slot 70. Therefore, crotch strap 38 extends upwardly from retainer 54 through slot 70. Main body 53 of carrier 14 includes an elongated, rectangular top plate 71, shown best in FIG. 3, and a plurality of ribs 73, shown in FIGS. 4–7, extending downwardly from an underside of top plate 71. Main body 53 further includes a front plate 64 extending downwardly from top plate 71 at the front end thereof and a pair of spaced-apart slide rails 72 extending downwardly from top plate 71 along the sides thereof.

Slide rails 72 are substantially perpendicular to top plate 71 and extend parallel to the longitudinal dimension of top plate 71. Ribs 73 are each substantially perpendicular to top plate 71 and extend transverse to the longitudinal dimension of top plate 71. Between each adjacent pair of ribs 73 are defined first, second, third, fourth, and fifth lock-receiving spaces which correspond, respectively, to the first, second, third, fourth, and fifth positions 30, 31, 32, 33, 34 of carrier. Hereinafter, the first lock-receiving space will be referred to as space 30, the second lock-receiving space will be referred to as space 31, and so on. Space 30 is the space closest to the front end of carrier 14 and space 34 is the space closest to the rear end of carrier 14.

Carrier 14 includes a pair of transversely spaced-apart fingers 59 that extend downwardly from top plate 71 within space 32, which is the middle space of the five spaces 30, 31, 32, 33, 34. Retainer 54 includes a pair of spaced-apart end portions 58, each of which is formed to include an opening 61, and a middle portion 63 extending between end portions 58. Middle portion 63 of retainer 54 is positioned to lie inside loop 52 formed at the lower end of crotch strap 38 and end portions 59 of retainer 54 extend beyond the respective opposite sides of loop 52. End portions 58 of retainer 54 are snap fit onto fingers 59 such that fingers 59 are received in openings 61. Fingers 59 are configured to hold retainer 54 in place relative to top plate 71.

Slide rails 72 of carrier 14 are positioned to lie in the spaces defined between plate 90 and second shoulder walls 74 such that the underside of each slide rail 72 rests upon respective walls 74. Thus, walls 74 provide sliding bearing surfaces on which rails 72 slide when carrier 74 moves in channel 78. Carrier 14 is configured so that only a minimal amount of clearance exists between the sides of rails 72 and intermediate vertical walls 89. Thus, walls 89 serve as guide surfaces that help to maintain the alignment of carrier 14 in channel 78. In addition, the shape of each of ribs 73 is complimentary to the contour of lower vertical walls 91 and bottom channel wall 77, as is the shape of front plate 64, such that only a minimal amount of clearance exists between walls 77, 91 and each of ribs 73 and front plate 64. Thus, walls 77 also serve as guide surfaces that help to maintain the alignment of carrier 14 in channel 78.

Seat bottom 18 includes a pair of stop detents 56, each of which is appended to and extends upwardly from a respective second shoulder wall 74 as shown in FIG. 3. Main body 53 of carrier 14 includes a transversely extending stop rib 66 that is appended to top plate 71 behind slot 70. Stop rib 66 extends upwardly from top plate 71 into slot 96 of plate 90. Front plate 64 of carrier 14 engages stop detents 56 to limit the amount that carrier 14 is able to move in channel 78 in forward direction 122 and stop rib 66 engages an edge 68 of end portion 94 to limit the amount that carrier 14 is able to move in channel 78 in rearward direction 124. Carrier 14 is configured so that when stop rib 66 engages edge 68 of end portion 94 of plate 90, as shown in FIG. 5, space 30 is aligned with aperture 28 as shown in FIG. 5. Thus, carrier 14 is in first position 30 when stop rib 66 engages edge 68. Furthermore, carrier 14 is configured so that when front plate 64 engages stop detents 56, space 34 is aligned with aperture 28. Thus, carrier 14 is in fifth position 34 when front plate 64 engages stop detents 56. When carrier 14 is in the second, third, and fourth positions 31, 32, 33, spaces 31, 32, 33, respectively, are aligned with aperture 28.

Carrier 14 is locked in respective first, second, third, fourth, and fifth positions 30, 31, 32, 33, 34 when lock member 24 is in the locking position having an upper portion of locking tab 26 received in the corresponding lock-receiving space 30, 31, 32, 33, 34. For example, receipt of locking tab 26 in space 30 locks carrier 14 in first position 30 as shown in FIG. 5, and receipt of locking tab 26 in space 32 locks carrier 14 in third position 32 as shown in FIG. 6. Tab 26 is sized so that only a minimal amount of clearance exists between tab 26 and each adjacent pair of ribs 73 that define the space in which locking tab 26 is received when lock member 24 is in the locking position. When lock member 24 is moved to the releasing position, as shown in FIG. 7, carrier 14 is free to translate in channel 78 between positions 30, 31, 32, 33, 34.

Positioning assembly 10 allows for quick and easy repositioning of crotch strap 38 relative to seat bottom 18. To change the position of crotch strap 38, the user simply lifts release button 84 to move lock member 24 to the releasing position, thereby disengaging tab 26 from carrier 14, and then the user moves crotch strap 38 and carrier 14 to a new, desired position having a selected one of spaces 30, 31, 32, 33, 34 aligned with aperture 28. After the crotch strap 38 and carrier are moved to the desired position, the user simply lets go of release button 84 and spring 120 causes lock member 24 to move automatically from the releasing position into the locking position having the upper portion of tab 26 received in the selected one of spaces 30, 31, 32, 33, 34 that is aligned with aperture 28.

An alternative embodiment of a juvenile seat assembly 220, shown in FIG. 8, includes an alternative crotch strap positioning assembly 210, shown in FIGS. 9–17. Many of the components of seat assembly 220 are substantially similar to components of seat assembly 20 and therefore, like reference numbers are used to denote like components. For example, seat assembly 220 includes a seat bottom 18, a seat back support 21, and a base coupling structure 19 that are substantially similar to the seat bottom 18, seat back support, and base coupling structure 19 of seat assembly 20. One of the differences between seat assembly 220 and seat assembly 20 is that seat assembly 220 includes a three-point harness assembly 212, whereas seat assembly 20 includes five-point harness assembly 12. Another difference between seat assembly 220 and seat assembly 20 is that crotch strap positioning assembly 210 of seat assembly 220 has a multi-piece carrier 214 that permits harness strap 240 to be attached thereto and detached therefrom, whereas crotch strap 38 of harness assembly 12 is fixed to carrier 14 and is not decoupled from carrier 14 during the normal operation of crotch strap positioning assembly 10.

Harness assembly 212 includes a harness strap 240 having upper, shoulder-strap portions 248 that extend over the shoulders of the child seated in seat assembly 220 and lower, crotch-strap portions 238 that are situated between the legs of the child seated in seat assembly 220. Harness assembly 212 also includes a pair of sliders 246, shown in FIG. 8, that couple together and a tab 244, shown best in FIG. 10, coupled to crotch strap portions 238. Illustrative harness strap 240 is a continuous strap that is threaded from a strap adjustment mechanism (not shown) situated on the back side of seat back 22, through one of slots 47 formed in panel 25, through associated slots formed in one of sliders 246, through a slot 251 formed in tab 244, through associated slots formed in the other of sliders 246, through the other of slots 47, and back to the strap adjustment mechanism.

Sliders 246 include mating elements, such as snaps, clips, hooks, tabs, or the like, that interface with each other to couple sliders 246 together. When sliders 246 are coupled together, the slots formed in sliders 246 are spaced apart laterally by a distance that is less than the amount by which slots 47 are spaced apart laterally. Thus, sliders 246 gather portions 248 together in the area of a child's chest or abdomen and prevent portions 248 from moving inadvertently around the sides of the child seated in seat assembly 220.

Tab 244 includes a flat, elongated first element 243 and a second element 245 that covers the upper portion of element 243. Slot 251 is formed in both elements 243, 245. Illustrative element 243 is made from a metal material and illustrative element 245 is made from a plastic material. However, it is understood that tab 244 may be made of any element or elements having suitable strength. Illustrative element 243 is formed to include a square-shaped aperture 247 at a lower end thereof as shown best in FIG. 10. It will be appreciated that aperture 247 need not be square-shaped.

Seat bottom 18 of seat assembly 220 is formed to include a channel 78 that is substantially the same as channel 78 formed in seat bottom 18 of seat assembly 20. Thus, channel 78 of seat assembly 220 is defined by and bounded by walls 74, 77, 87, 88, 89, 91, each of which extends longitudinally rearwardly from front wall 82 of seat bottom 18 and terminates at a rear edge 93. Carrier 214 is received in channel 78 for longitudinal translating movement relative to seat bottom 18. Thus, carrier 214 is movable on seat bottom 18 in a forward direction (i.e. away from seat back 22) as indicated by arrow 122, shown in FIG. 10, and in a rearward direction (i.e. toward seat back 22) as indicated by arrow 124, also shown in FIG. 10.

Figure 9:
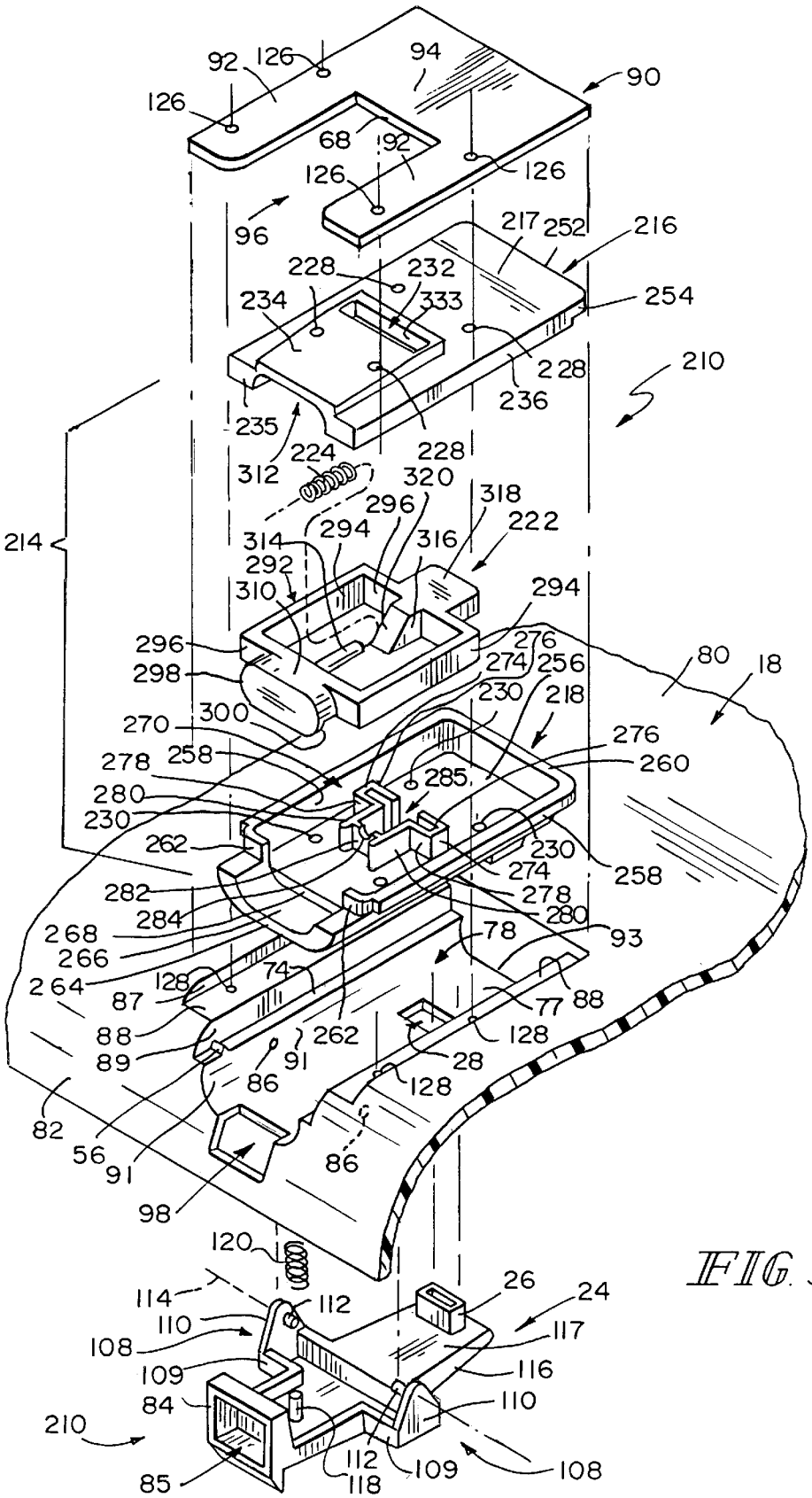
FIG. 9 is an exploded perspective view of an alternative crotch strap positioning assembly included in the seat assembly of FIG. 8 showing the seat bottom having a channel formed therein, a plate at the top of the page, pieces of a multi-piece carrier between the plate and the channel, and a pivotable lock member beneath the channel.

Seat bottom 18 of seat assembly 220 is formed to include a first aperture 98 and a second aperture 28 as shown in FIG. 9. Aperture 98 is formed in seat bottom 18 at the junction between front wall 82 and bottom channel wall 77. Aperture 28 is formed in bottom channel wall 77 between aperture 98 and rear edge 93 of channel 78. In addition, each lower vertical wall 91 is formed to include a pivot aperture 86. Pivot apertures 86 are aligned with one another and are situated about midway between aperture 28 and aperture 98.

Figure 10:
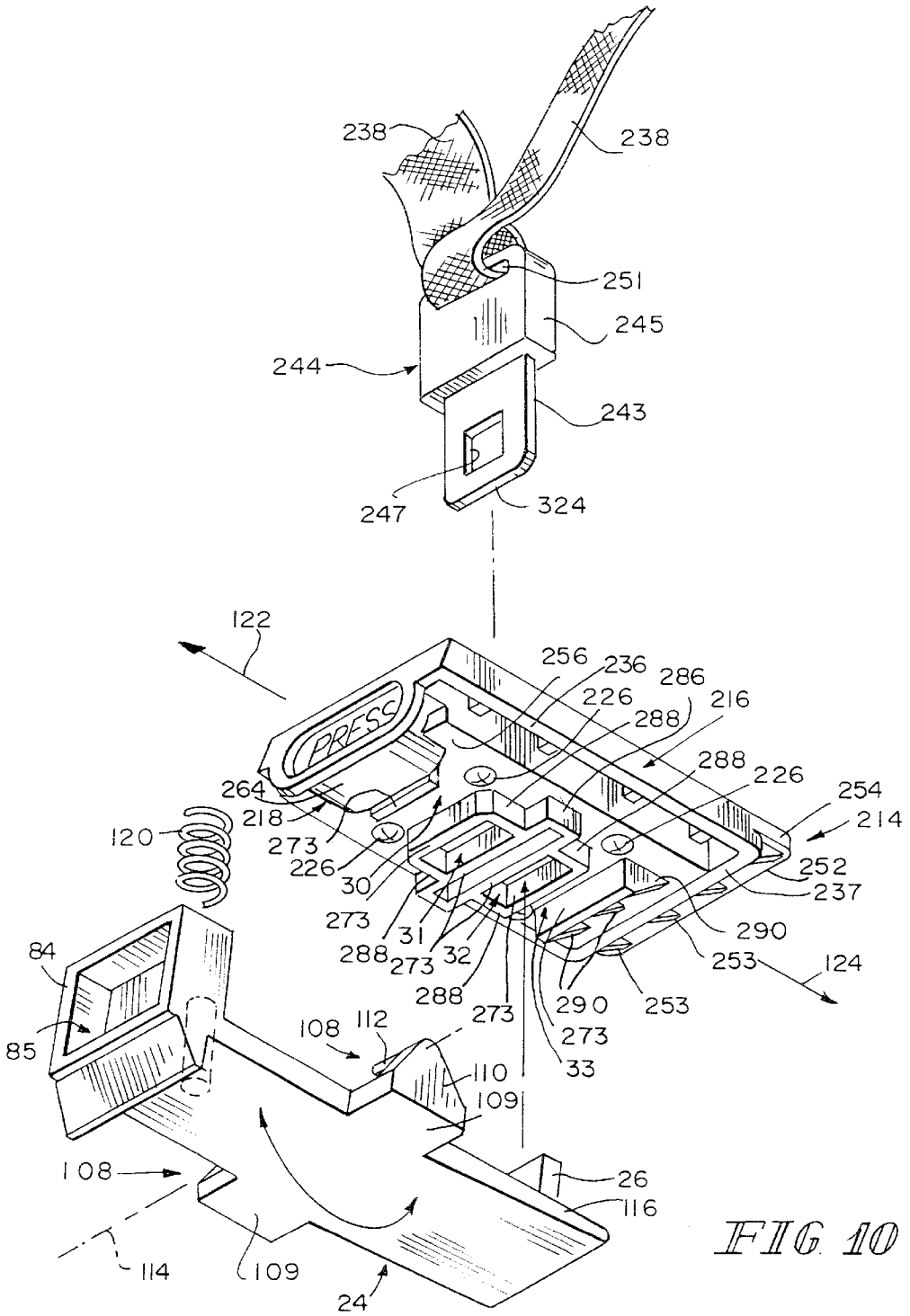
FIG. 10 is an exploded perspective view of portions of the alternative crotch strap positioning assembly of FIG. 9 showing a harness tab arranged for insertion into a slot formed in the carrier, a crotch strap portion of the harness assembly threaded through an upper end of the harness tab, the carrier including a plurality of downwardly extending ribs defining first and second lock-receiving spaces in front of the slot and defining third and fourth lock-receiving spaces in back of the slot, and a locking tab of the pivotable lock member being sized for receipt in each of the lock-receiving spaces.

Crotch strap positioning assembly 210 includes a lock member 24 and a biasing element 120, shown, for example, in FIGS. 9 and 10, that are substantially the same as lock member 24 and element 120 of positioning assembly 10. Thus, like reference numbers are used to identify portions of lock member 24 of positioning assembly 210 that correspond to portions of lock member 24 of positioning assembly 10. Thus, lock member 24 is coupled to seat bottom 18 and is movable between a locking position, shown in FIGS. 11, 12, and 14–17, and a releasing position, shown in FIG. 13.

When lock member 24 is in the locking position, locking tab 26 of lock member 24 engages carrier 214 preventing carrier 214 from moving relative to seat bottom 18. By locking carrier 214 in place on seat bottom 18, the attachment point of crotch strap portions 238 (referred to hereinafter as crotch strap 238) to tab 244 is fixed relative to seat back 22 in one of four positions 30, 31, 32, 33, thereby adapting harness assembly 212 to the size of the child occupying seat assembly 20. When lock member 24 is moved to the releasing position, locking tab 26 of lock member 24 disengages from carrier 214 allowing carrier 214 to move relative to seat bottom 18 so that adjustments in the position of crotch strap 238 relative to seat bottom 18 can be made easily by a caregiver. Thus, when lock member 24 is in the releasing position, carrier 214 and crotch strap 238 can be moved closer to seat back 22 to adjust harness assembly 212 to accommodate a smaller child and farther away from seat back 22 to adjust harness assembly 212 to accommodate a larger child.

Seat assembly 220 includes a plate 90 coupled to seat bottom 18 to retain carrier 214 in channel 78. Plate 90 of seat assembly 220 is substantially the same as plate 90 of seat assembly 20 and therefore, like reference numerals are used to denote like portions of plate 90. Plate 90 rests upon first shoulder walls 88 and attaches thereto by suitable fasteners (not shown). Thus, plate 90 retains carrier 214 in channel 78 and prevents carrier 214 from being lifted upwardly out of channel 78. When tab 244 is coupled to carrier 214, a portion of tab 244 is received in slot 96 of plate 90 and crotch strap 238 extends upwardly from tab 244. In addition, tab 244 moves in slot 96 away from end portion 94 of plate 90 when carrier 214 moves forwardly relative to seat bottom 18 in direction 122 and tab 244 moves in slot 96 toward end portion 94 of plate 90 when carrier 214 moves rearwardly relative to seat bottom 18 in direction 124.

Carrier 214 includes an upper body portion 216, a lower body portion 218, a slidable lock member 222, and a biasing element 224 as shown in FIG. 9. Body portions 216, 218 couple together with suitable fasteners, such as screws 226, shown in FIG. 10, to provide a main body of carrier 214. Portion 216 is formed to include threaded apertures 228 and portion 218 is formed to included threaded apertures 230, each of which is aligned with a corresponding aperture 228. Screws 226 are received by apertures 228, 230 to couple portions 216, 218 together. Biasing element 224 and slidable lock member 222 are retained within an interior region defined between portions 216, 218.

Upper body portion 216 is generally rectangular having a flat, upper plate 217. In addition, portion 216 is formed to include a slot 232 therethrough as shown in FIG. 9. Portion 216 includes a stop rib 233 behind slot 232 and a ramp 234 in front of slot 232. Stop rib 233 and ramp 234 extend upwardly from plate 217 and are sized to fit within slot 96 formed in plate 90. Plate 217 of portion 216 underlies plate 90 so that a top surface of plate 217 confronts the underside of plate 90 with a minimal amount of clearance therebetween. Portion 216 includes a front wall 235 and a pair of rail portions 236 appended to the underside of plate 217. Rail portions 236 extend rearwardly from front wall 235 along the sides of plate 217. Rail portions 236 terminate at a back wall 237, shown, for example, in FIG. 10. Back wall 237 is spaced apart from a back end edge 252 of portion 216 and a plurality of traingular-shaped, reinforcing webs 253 are appended to back wall 237 and to a tailpiece section 254 of plate 217.

Lower body portion 218 is generally rectangular having a bottom wall 256, a pair of side walls 258 extending upwardly from bottom wall 256, a back wall 260 extending upwardly from bottom wall 256, and a pair of front wall portions 262 extending upwardly from bottom wall 256 as shown in FIG. 9. Back wall 260 and front wall portions 262 join with side walls 258 at comer regions of portion 218. Portion 218 further includes a button-guide wall 264 extending forwardly from front wall portions 262 and from bottom wall 256. Button-guide wall 264 includes an upwardly facing, concave guide surface 266 and an end of bottom wall 256 provides a transversely extending, vertical button stop surface 268.

Portion 218 includes a guiding structure 270 appended to the top surface of bottom wall 256. Bottom wall 256 is formed to include a slot 272, shown, for example, in FIG. 11. Structure 270 includes a pair of short guide walls 274, shown in FIG. 9, extending upwardly from bottom wall 256 in the vicinity of the ends of slot 270. Structure 270 further includes a pair of transverse rear walls 276 extending from guide walls 274 toward a centerline of bottom portion 218 and a pair of transverse front walls 278 extending from guide walls 274 toward the centerline of bottom portion 218. Walls 276 are parallel to walls 278 and are spaced-apart from walls 278 by an amount that is substantially equivalent to the width of slot 272. Thus, walls 274, 276, 278 outline end portions of slot 270. Structure 270 includes a pair of longitudinal side walls 280 extending forwardly from walls 278 and a spring-engaging wall 282 extending transversely between walls 280. An upper edge of wall 282 is formed to include a post-engaging notch 284. Walls 276 terminate at confronting vertical edges to define a lug-receiving space 285 therebetween.

Portion 218 includes a plurality of transversely extending ribs 273 appended to an udersurface of bottom wall 256 and extending downwardly therefrom as shown in FIG. 10. Lock-receiving spaces corresponding to the first, second, third, and fourth positions 30, 31, 32, 33 of carrier 214 are defined between adjacent pairs of ribs 273. Hereinafter, the first lock-receiving space of carrier 214 will be referred to as lock-receiving space 30, the second lock-receiving space of carrier 214 will be referred to as lock-receiving space 31, and so on. Portion 218 includes a pair of short longitudinal walls 286 interconnecting the ends of the two middle ribs 273 such that walls 286 and the two middle ribs 273 outline slot 270 formed in bottom wall 256. Portion 218 also includes a set of longitudinal walls 288 interconnecting the ribs 273 associated with spaces 31, 32. In addition, portion 218 includes a set of reinforcing webs 290 appended to the rearmost rib 273 and to bottom wall 256.

Slidable lock member 222 of carrier 214 includes a rectangular frame 292 having a pair of side frame members 294 and a pair of end frame members 296 as shown in FIG. 9. A release button 298 is appended to an outer vertical surface of the front end frame member 296 and extends forwardly therefrom. A lower lip 300 of button 298 is shaped to conform to concave guide surface 266. In addition, an upwardly facing surface 310 of button 298 is shaped to conform to a concave notch 312 formed in front wall 235 of upper portion 216 of carrier 214. Illustrative button 298 is oval-shaped and notch 312 cooperates with surface 366 to define an oval-shaped cavity in which button 298 is received for longitudinal movement.

Lock member 222 includes a post 314 extending horizontally from the inner vertical surface of the front end frame member 296 in a cantilevered manner as shown in FIG. 9. Illustrative biasing element 224 is a coil spring (hereinafter referred to as spring 224) that mounts onto post 314 such that a front end of spring 224 abuts the inner vertical surface of the front end frame member 296 and such that the rear end of spring 224 abuts spring-engaging wall 282 of guiding structure 270. Post 314 extends out of the bore of spring 224 and engages notch 284. Spring 224 is maintained in a state of compression and biases lock member 222 toward a locking position. In the locking position, the inner vertical surface of the rear end frame member 296 abuts transverse end walls 276 of guiding structure 270.

Lock member 222 also includes a lug 316 extending horizontally from the inner vertical surface of the rear end frame member 296 in a cantilevered manner and a stop tab 318 extending horizontally from the outer vertical surface of the rear end frame member 296 in a cantilevered manner. Lug 316 includes an inclined ramp surface 320 that is positioned to lie beneath slot 232 formed in upper portion 216 when lock member 222 is in the locking position as shown in FIGS. 12–16. In addition, when lock member 222 is in the locking position, a rear portion of lug 316 is received in lug-receiving space 285, an intermediate portion of lug 316 overlies slot 272 formed in bottom wall 256, and a front portion of lug 316 is positioned to lie between side walls 280 of guiding structure 270.

Tab 244 is couplable or attachable to carrier 214 and is decouplable or detachable from carrier 214. During attachment of tab 244 to carrier 214, tab 244 is inserted downwardly through slot 232 formed in upper housing portion 218 in a direction indicated by arrow 322 shown in FIG. 11. As tab 244 moves downwardly in direction 322, a tip 324 of element 243 of tab 244 engages ramp surface 320 and moves lock member 222 rearwardly in a direction indicated by arrow 326, shown in FIG. 11. As lock member 222 moves in direction 326, spring 224 is further compressed between wall 282 and the front end frame member 296, while post 314 slides upon notch 284.

Figure 12:
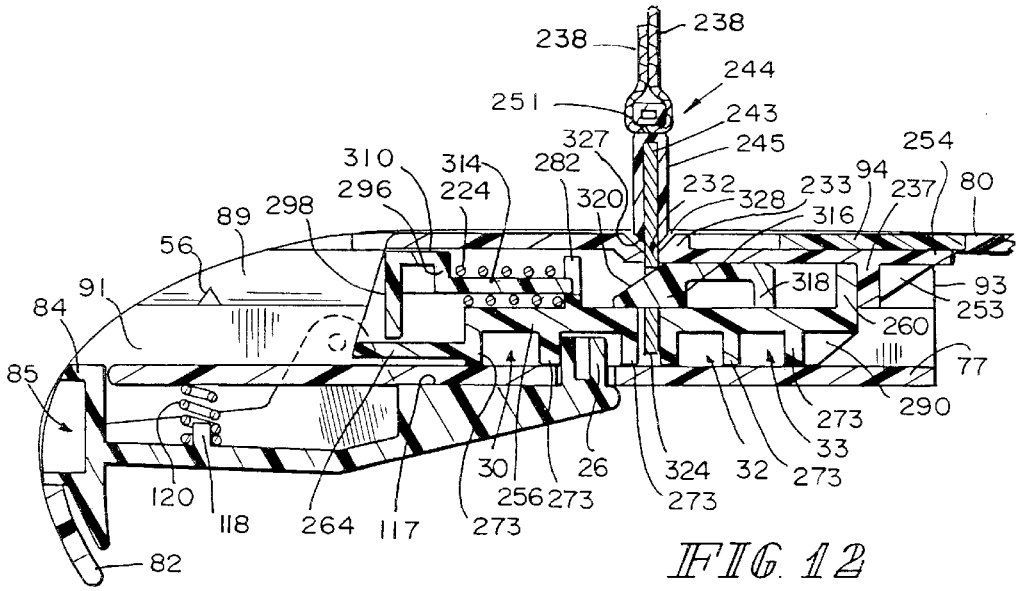
FIG. 12 is a sectional view similar to FIG. 11 showing the harness tab inserted fully into the slot of the carrier, a lug of the slidable lock member being received in an aperture formed in the harness tab to lock the harness tab to the carrier thereby coupling the crotch strap portion of the harness assembly to the carrier.

When tab 244 is fully inserted into carrier 214 in direction 322, an upper portion of element 243 is received in slot 232 formed in upper body portion 216 and a lower portion of element 243 is received in slot 272 formed in lower body portion 218 as shown in FIG. 12. In addition, tip 324 of element 243 is positioned to lie between the two middle ribs 273 that are appended to bottom wall 256 when tab 244 is fully inserted in carrier 214. As tab 244 is being inserted into carrier 214, walls 274, 276, 278 of guiding structure 270 guide the movement of element 243 and maintain tab 244 in an orientation that is substantially perpendicular to top plate 217 and to bottom wall 256. Bottom edges 327 of element 245 are chamfered and engage inclined surfaces 328 that bound slot 232 formed in upper body portion 216 to limit the amount of insertion of tab 244 into carrier 214 in direction 322.

Figure 16:
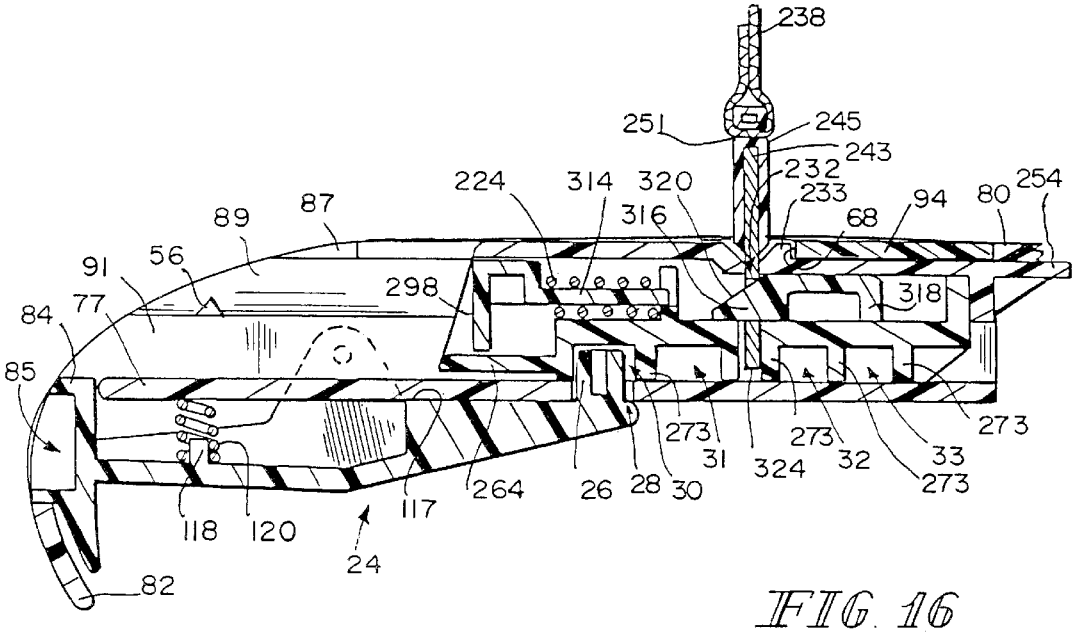
FIG. 16 is a sectional view similar to FIG. 15 showing the pivotable lock member in the locking position having the locking tab received in the first lock-receiving space to lock the carrier in a first position.
Figure 17:
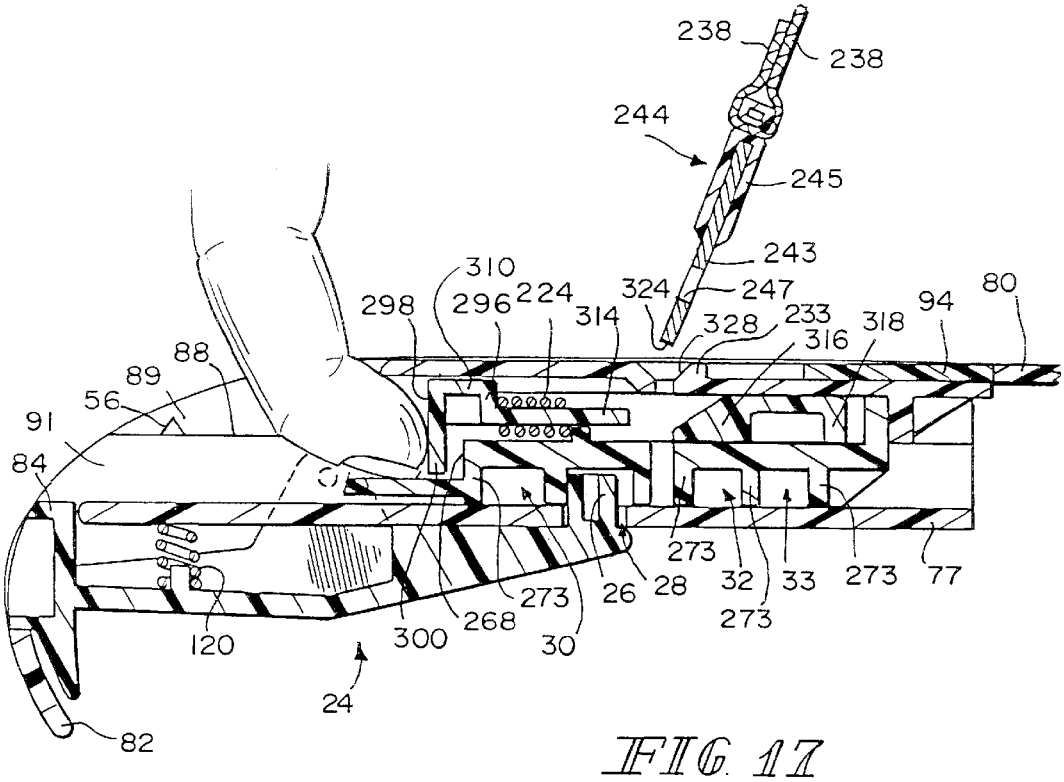
FIG. 17 is a sectional view similar to FIG. 12 showing the slidable lock member moved to a releasing position having the lug moved out of the aperture formed in the harness tab to permit decoupling of the harness tab and crotch strap portion from the carrier.

Upon movement of tab 244 to its fully inserted position in carrier 214, lug 316 aligns with aperture 247 formed in element 243 and spring 224 biases lock member 222 to move automatically to the locking position in a direction opposite to direction 326 so that lug 316 moves into aperture 247. Receipt of lug 316 in aperture 247 couples tab 244 and crotch strap 238 to carrier 214. To decouple tab 244 from carrier 214, a caregiver presses button 298 to move lock member 222 in direction 326 from the locking position, shown in FIGS. 12–16 to a releasing position, shown in FIG. 17. Lock member 222 is configured so that lip 320 of button 298 will engage stop surface 268 or else stop tab 318 will engage back wall 260 of portion 218 to prevent the distal end of post 314 from entering inadvertently into aperture 247 formed in element 243 of tab 244. When lock member 222 moves to the releasing position, lug 316 is withdrawn from aperture 247 of element 243 allowing the caregiver to lift tab 244 upwardly in a direction opposite to direction 322 to detach tab 244 from carrier 214 as shown in FIG. 17.

A minimal amount of clearance exists between walls 274 of guiding structure 270 and inner vertical surfaces of side frame members 294 of lock member 222 and a minimal amount of clearance exists between side walls 258 of lower housing portion 218 and outer vertical surfaces of side frame members 294. Thus, as lock member 222 moves in direction 326 and as lock member 222 moves in the direction opposite to direction 326, walls 274 cooperate with walls 258 to maintain the alignment of lock member 222 relative to body portions 216, 218 of carrier 214. In addition, lock member 222 rests upon bottom wall 256 and slides relative to bottom wall 256 during movement in direction 326 and in the direction opposite to direction 326. Top plate 217 overlies lock member 222 with a minimal amount of clearance therebetween.

Rail portions 236 of carrier 214 are positioned to lie in the spaces defined between plate 90 and second shoulder walls 74 such that the underside of each rail portion 236 rests upon respective walls 74. Thus, walls 74 provide sliding bearing surfaces on which rail portions 236 slide when carrier 214 moves in channel 78 in directions 122, 124. Carrier 214 is configured so that only a minimal amount of clearance exists between the sides of rail portions 236 and intermediate vertical walls 89. Thus, walls 89 serve as guide surfaces that help to maintain the alignment of carrier 214 in channel 78. In addition, only a minimal amount of clearance exists between plate 90 and top plate 217 of portion 216.

Figure 15:
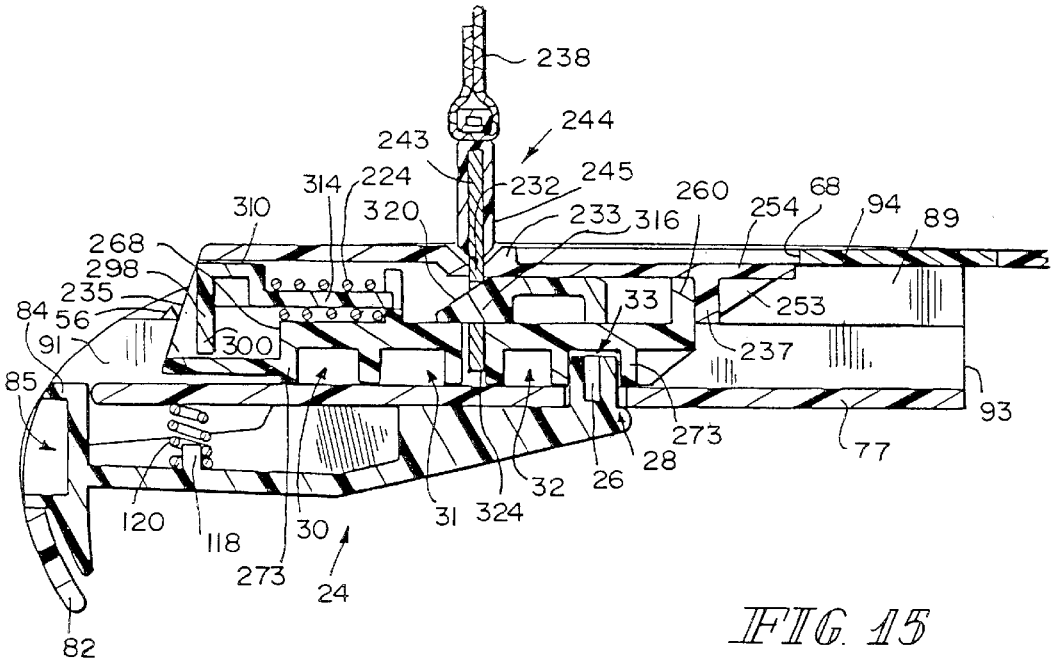
FIG. 15 is a sectional view similar to FIG. 14 showing the pivotable lock member in the locking position having the locking tab received in the fourth lock-receiving space to lock the carrier in a fourth position.

Seat bottom 18 of seat assembly 220 includes a pair of stop detents 56, each of which is appended to and extends upwardly from a respective second shoulder wall 74. Front wall 235 of carrier 214 engages stop detents 56, as shown in FIG. 15, to limit the amount that carrier 214 is able to move in channel 78 in forward direction 122 and stop rib 233 engages an edge 68 of end portion 94, as shown in FIG. 16, to limit the amount that carrier 214 is able to move in channel 78 in rearward direction 124. Carrier 214 is configured so that when stop rib 233 engages edge 68 of end portion 94 of plate 90, space 30 is aligned with aperture 28 as shown in FIG. 16. Thus, carrier 214 is in first position 30 when stop rib 233 engages edge 68. Furthermore, carrier 214 is configured so that when front wall 235 engages stop detents 56, space 33 is aligned with aperture 28. Thus, carrier 214 is in fourth position 33 when front wall 235 engages stop detents 56. When carrier 214 is in the second and third positions 31, 32, spaces 31, 32, respectively, are aligned with aperture 28.

Figure 11:
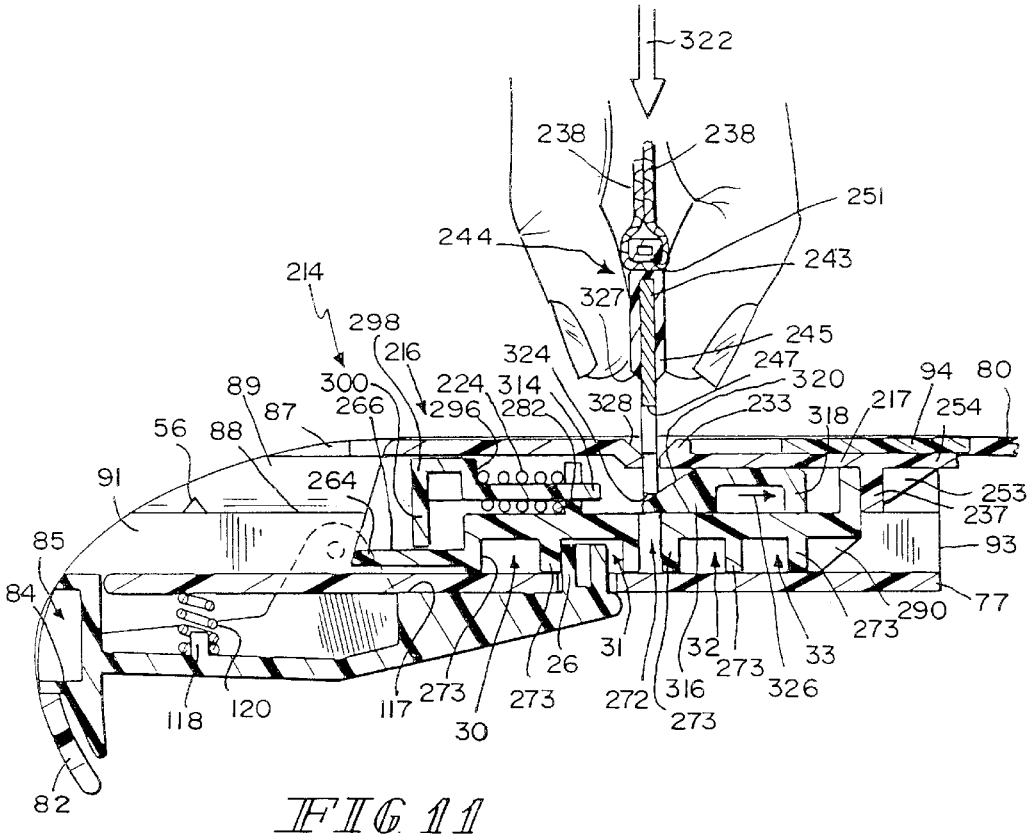
FIG. 11 is a sectional view taken through the alternative crotch strap positioning assembly showing the pivotable lock member in a locking position having the locking tab of the lock member received in the second lock-receiving space to lock the carrier in a second position, the harness tab being inserted downwardly in the direction of the vertical arrow through the slot formed in the carrier, and a tip of the harness tab engaging a ramp surface of a slidable lock member to move the slidable lock member to the right in the direction of the horizontal arrow.
Figure 13:
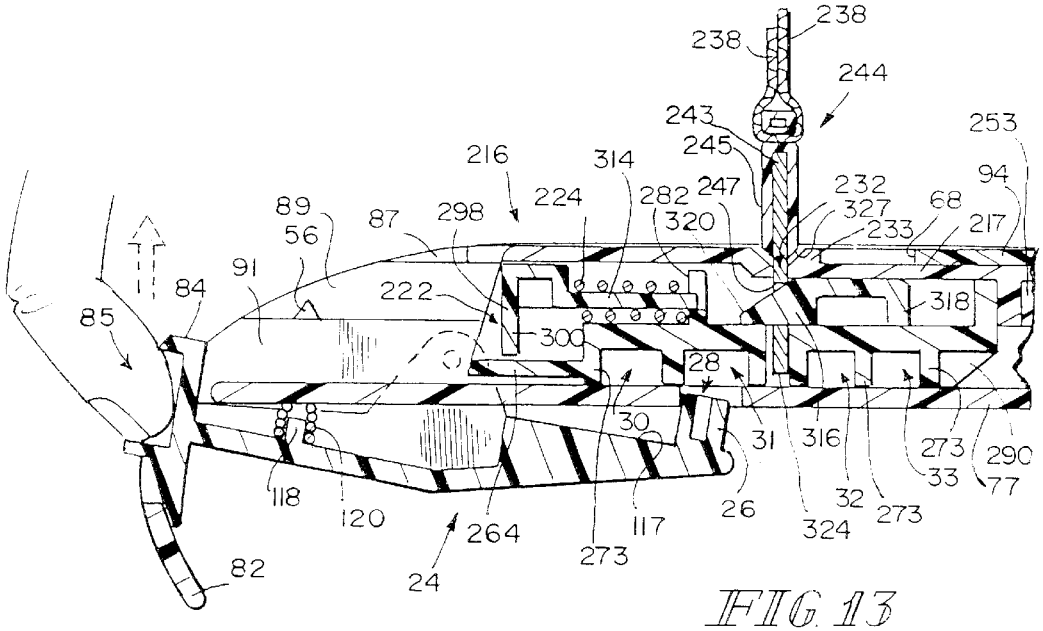
FIG. 13 is a sectional view similar to FIG. 12 showing the pivotable lock member moved to a releasing position having the locking tab withdrawn from the second lock-receiving space to permit movement of each of the carrier, the harness tab and the crotch strap portion relative to the seat.
Figure 14:
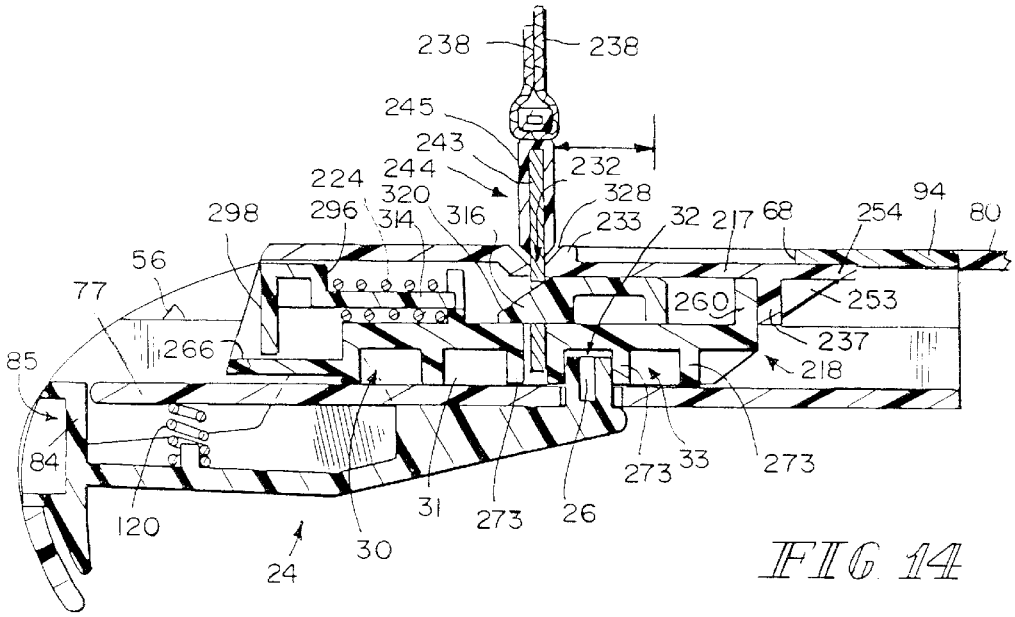
FIG. 14 is a sectional view similar to FIG. 12 showing the pivotable lock member in the locking position having the locking tab received in the third lock-receiving space to lock the carrier in a third position.

Carrier 214 is locked in respective first, second, third, and fourth positions 30, 31, 32, 33, 34 when lock member 24 is in the locking position having an upper portion of locking tab 26 received in the corresponding lock-receiving space 30, 31, 32, 33. Thus, receipt of locking tab 26 in space 30 locks carrier 214 in first position 30 as shown in FIG. 16, receipt of locking tab 26 in space 31 locks carrier 214 in second position 31 as shown in FIGS. 11 and 12, receipt of locking tab 26 in space 32 locks carrier 214 in third position 32 as shown in FIG. 14, and receipt of locking tab 26 in space 33 locks carrier 214 in fourth position 33 as shown in FIG. 15. Tab 26 is sized so that only a minimal amount of clearance exists between tab 26 and each adjacent pair of ribs 273 that define the space in which locking tab 26 is received when lock member 24 is in the locking position. When lock member 24 is moved to the releasing position, as shown in FIG. 13, carrier 214 is free to translate in channel 78 between first, second, third, and fourth positions 30, 31, 32, 33.

Positioning assembly 210 allows for quick and easy repositioning of crotch strap 238 relative to seat bottom 18. To change the position of crotch strap 238, the user simply lifts release button 84 to move lock member 24 to the releasing position, thereby disengaging tab 26 from carrier 214, and then the user moves crotch strap 238 and carrier 214 to a new, desired position having a selected one of spaces 30, 31, 32, 33 aligned with aperture 28. After the crotch strap 238 and carrier 214 are moved to the desired position, the user simply lets go of release button 84 and spring 120 causes lock member 24 to move automatically from the releasing position into the locking position having the upper portion of tab 26 received in the selected one of spaces 30, 31, 32, 33 that is aligned with aperture 28.

Positioning assembly 210 also allows for quick and easy coupling and decoupling of crotch strap 238 to carrier 214. To couple crotch strap 238 to carrier 214, a caregiver simply inserts tab 244 into carrier 214. To decouple crotch strap 238 from carrier 214, the caregiver simply presses button 298 and lifts tab 244 out of carrier 214. Carrier 214 is movable between positions 30, 31, 32, 33 with crotch strap 238 coupled to carrier 214 and with crotch strap 238 decoupled from carrier 214.

Although illustrative carrier 14 is formed to include five lock-receiving spaces 30, 31, 32, 33, 34 allowing carrier 14 to be lockable in five positions 30, 31, 32, 33, 34 and although illustrative carrier 214 is formed to include four lock-receiving spaces 30, 31, 32, 33, it is within the scope of this disclosure for carriers 14, 214 to be configured with a different number of lock-receiving spaces allowing carriers 14, 214 to be lockable in a different number of positions. Thus, the phrase "plurality of positions" as used in the specification and in the claims is intended to cover any number of positions more than one, unless specifically mentioned otherwise.

Illustrative main body 53 of carrier 14 is a unitary piece having top plate 71, front plate 64, ribs 73, and slide rails 72 formed integrally with one another, whereas carrier 214 includes separate body portions 216, 218. Thus, the term "main body" as used in the specification and in the claims is intended to cover any unitary body and any multi-component body. Furthermore, illustrative crotch strap 38 is a single strap that is permanently coupled to carrier 14 by retainer 54 (i.e. crotch strap 38 is not decoupled from carrier 14 during normal use of seat assembly 20), whereas crotch strap 238 comprises portions of a continuous strap 240 that are coupled to tab 244 which is selectively couplable to and decouplable from carrier 214. Thus, the term "crotch strap" as used in the specification and in the claims is intended to cover any type of strap or straps or other flexible members that are received between the legs of a child seated in a seat assembly. In addition, unless specifically noted otherwise, the term "coupled" as used in the claims with reference to the relationship between a crotch strap and a carrier is intended to cover a crotch strap that is permanently coupled to a carrier, a crotch strap that is coupled to a carrier but that is also selectively decouplable from the carrier, and a crotch strap that is coupled to another element which is coupled to a carrier but which is also selectively decouplable from the carrier.

Furthermore, although illustrative channel 78 of seat bottom 18 is defined by walls 74, 77, 87, 88, 89, 91 which are formed integrally with top wall 80 and front wall 82 of seat bottom 18, it is within the scope of this disclosure for channel 78 to be defined by one or more channel elements which are separate from a seat bottom and that couple thereto. Thus, the phrases "includes a channel," "including a channel," "formed to include a channel," and the like used in the specification and in the claims are intended to cover channels that are formed integrally with a referred to component, such as a seat bottom, as well as channels that are comprised of one or more separate channel elements.

It will be appreciated that, although crotch strap positioning assemblies 10, 210 are described herein as being included in illustrative seat assemblies 20, 220, respectively, having seat bottom 18, seat back support 21, base coupling structure 19, and sidewalls 23 formed integrally with one another to form a seat shell, it is within the scope of this disclosure for crotch strap positioning assemblies to be used in other types of seat assemblies. Thus, the term "seat assembly" is intended to cover broadly all types of seat assemblies including those with integrally formed seat shells, those having seat shells constructed from multiple separate elements that couple together, and those in which elements, such as base coupling structure 19 and sidewalls 23, are omitted.

Although the invention has been described in detail with reference to certain preferred embodiments, variations and modifications exist within the scope and spirit of the invention as described and defined in the following claims.

What is claimed is:

1. A juvenile seat assembly comprising a seat bottom, a crotch strap, a carrier coupled to the seat bottom for movement relative to the seat bottom, the carrier being lockable in a plurality of positions, the crotch strap being coupled to the carrier to move therewith, and a lock member coupled to the seat bottom and movable between a locking position engaging the carrier to prevent the carrier from moving relative to the seat bottom and a releasing position disengaged from the carrier to allow movement of the carrier relative to the seat bottom.

2. The juvenile seat assembly of claim 1, wherein the seat bottom includes a channel and the carrier is positioned to lie in the channel.

3. The juvenile seat assembly of claim 2, wherein the carrier includes a pair of rails, the channel is a stepped channel having a pair of upwardly facing shoulder surfaces, and the rails of the carrier slide upon the upwardly facing shoulder surfaces.

4. The juvenile seat assembly of claim 2, further comprising a plate coupled to the seat bottom, the plate having portions that overlie the carrier to retain the carrier in the channel.

5. The juvenile seat assembly of claim 2, wherein the seat bottom includes a channel bottom wall beneath the channel, the channel bottom wall is formed to include an aperture, and the lock member includes a locking tab that extends upwardly through the aperture to engage the carrier when the lock member is in the locking position.

6. The juvenile seat assembly of claim 5, wherein the seat bottom includes a pair of channel side walls extending upwardly from the channel bottom wall, the lock member is positioned to lie underneath the seat bottom, and the lock member is pivotably coupled to the channel side walls.

7. The juvenile seat assembly of claim 1, wherein the seat bottom is formed to include an aperture, the lock member includes a first portion positioned to lie beneath the seat bottom, and the lock member includes a second portion that extends upwardly from the first portion through the aperture to engage the carrier.

8. The juvenile seat assembly of claim 1, wherein the seat bottom is formed to include a first aperture and a second aperture, the lock member includes a locking tab extending through the first aperture, and the lock member includes a release button extending through the second aperture.

9. The juvenile seat assembly of claim 1, wherein the crotch strap includes a loop, the carrier includes a main body and a retainer, the retainer includes a middle portion received in the loop, and the retainer includes end portions that couple to the main body.

10. The juvenile seat assembly of claim 9, wherein the main body of the carrier is formed to include a slot, the retainer is positioned to lie beneath the slot, and the crotch strap extends upwardly from the retainer through the slot.

11. The juvenile seat assembly of claim 9, wherein the main body of the carrier is formed to include a pair of fingers and the end portions of the retainer are each formed to include an opening that receives a respective finger.

12. The juvenile seat assembly of claim 1, further comprising a buckle, the crotch strap having a lower end coupled to the carrier, and the crotch strap having an upper end coupled to the buckle.

13. The juvenile seat assembly of claim 1, wherein the carrier is formed to include a plurality of lock-receiving spaces and the lock member includes a locking tab receivable in each of the lock-receiving spaces to lock the carrier from moving relative to the seat bottom.

14. The juvenile seat assembly of claim 13, wherein the carrier includes a top plate and a plurality of ribs extending downwardly from the top plate, the ribs separating the lock-receiving spaces from one another.

15. The juvenile seat assembly of claim 1, further comprising a biasing element that biases the lock member toward the locking position.

16. The juvenile seat assembly of claim 15, wherein the biasing element includes a first portion abutting the seat bottom and a second portion abutting the lock member.

17. The juvenile seat assembly of claim 15, wherein the biasing element includes a coil spring having a first end abutting the seat bottom and a second end abutting the lock member.

18. The juvenile seat assembly of claim 17, wherein the coil spring has a bore and the lock member includes a post received by the bore to hold the coil spring in place relative to the lock member.

19. The juvenile seat assembly of claim 1, wherein the crotch strap is detachable from the carrier.

20. The juvenile seat assembly of claim 1, wherein the crotch strap is coupled to the carrier by a tab.

21. The juvenile seat assembly of claim 20, wherein the carrier is formed to include a slot that receives the tab.

22. The juvenile seat assembly of claim 20, wherein the carrier includes a slidable lock member that engages the tab to couple the tab and crotch strap to the carrier.

23. A juvenile seat assembly comprising a seat bottom, a crotch strap, and means coupled to the seat bottom and coupled to the crotch strap for adjusting the position of the crotch strap relative to the seat bottom, the adjusting means including a carrier retained on the seat bottom for sliding movement between a plurality of positions, the crotch strap being coupled to the carrier to move therewith.

24. The juvenile seat assembly of claim 23, wherein the crotch strap is detachable from the adjusting means.

25. The juvenile seat assembly of claim 23, wherein the adjusting means includes a lock member that engages the carrier to lock the carrier in a selected position of the plurality of positions.

26. The juvenile seat assembly of claim 23, wherein the seat bottom includes a channel and at least a portion of the adjusting means is positioned to lie in the channel.

27. The juvenile seat assembly of claim 23, wherein the crotch strap is coupled to the adjusting means by a tab.

28. The juvenile seat assembly of claim 27, wherein the adjusting means includes a carrier that is formed to include a slot which receives the tab.

29. The juvenile seat assembly of claim 27, wherein the adjusting means includes a slidable lock member that engages the tab to couple the tab and crotch strap to the adjusting means.

30. A juvenile seat assembly comprising a seat bottom, a crotch strap, and means coupled to the seat bottom and coupled to the crotch strap for adjusting the position of the crotch strap relative to the seat bottom, the adjusting means including a carrier that is movable relative to the seat bottom and that is lockable relative to the seat bottom, the crotch strap being coupled to the carrier to move therewith, and the adjusting means including a button that is moved to selectively lock and unlock the carrier.

31. A juvenile seat assembly comprising a seat bottom, a crotch strap, and means coupled to the seat bottom and coupled to the crotch strap for adjusting the position of the crotch strap relative to the seat bottom, the seat bottom being formed to include an aperture, the adjusting means including a carrier that is slidable on the seat bottom above the aperture, the adjusting means including a lock member coupled to an underside of the seat bottom, and the lock member including a locking tab that extends through the aperture to engage the carrier to prevent the carrier from sliding on the seat bottom.

32. A juvenile seat assembly comprising a seat bottom formed to include a channel, a crotch strap, and a carrier received in the channel and movable in the channel relative to the seat bottom, the crotch strap being coupled to the carrier to move therewith, and the carrier being lockable in the channel in a plurality of positions.

33. The juvenile seat assembly of claim 32, wherein the carrier includes a pair of rails, the channel is a stepped channel having a pair of upwardly facing shoulder surfaces, and the rails of the carrier slide upon the upwardly facing shoulder surfaces.

34. The juvenile seat assembly of claim 32, further comprising a plate coupled to the seat bottom, the plate having portions that overlie the carrier to retain the carrier in the channel.

35. The juvenile seat assembly of claim 32, further comprising a lock member coupled to the seat bottom, the lock member having a locking position preventing movement of the carrier, and the lock member having a releasing position allowing movement of the carrier.

36. The juvenile seat assembly of claim 35, wherein the seat bottom includes a channel bottom wall beneath the channel, the channel bottom wall is formed to include an aperture, and the lock member includes a locking tab that extends upwardly through the channel to engage the carrier when the lock member is in the locking position.

37. The juvenile seat assembly of claim 36, wherein the seat bottom includes a pair of channel side walls extending upwardly from the channel bottom wall, the lock member is positioned to lie underneath the seat bottom, and the lock member is pivotably coupled to the channel side walls.

38. The juvenile seat assembly of claim 35, wherein the carrier is formed to include a plurality of lock-receiving spaces and the lock member includes a locking tab receivable in each of the lock-receiving spaces to lock the carrier from moving relative to the seat bottom.

39. The juvenile seat of claim 32, further comprising a plate coupled to the seat bottom and the plate including a portion that overlies the carrier to retain the carrier in the channel.

40. The juvenile seat of claim 39, wherein the plate is formed to include a slot and the crotch strap extends from the carrier through the slot.

41. The juvenile seat assembly of claim 32, wherein the crotch strap is detachable from the carrier.

42. The juvenile seat assembly of claim 32, wherein the crotch strap is coupled to the carrier by a tab.

43. The juvenile seat assembly of claim 42, wherein the carrier is formed to include a slot that receives the tab.

44. The juvenile seat assembly of claim 42, wherein the carrier includes a slidable lock member that engages the tab to couple the tab and crotch strap to the carrier.

* * * * *